US006895906B1

(12) United States Patent
Gahan

(10) Patent No.: US 6,895,906 B1
(45) Date of Patent: May 24, 2005

(54) ROTARY TWO-STROKE ENGINE

(76) Inventor: John Peter Gahan, P.O. Box 3500, Parramatta (AU), 2124

( * ) Notice: Subject to any disclaimer, the term of this patent is extended or adjusted under 35 U.S.C. 154(b) by 0 days.

(21) Appl. No.: 09/600,320

(22) PCT Filed: Sep. 17, 1998

(86) PCT No.: PCT/AU98/00767

§ 371 (c)(1),
(2), (4) Date: Jul. 16, 2000

(87) PCT Pub. No.: WO99/18332

PCT Pub. Date: Apr. 15, 1999

(30) Foreign Application Priority Data

Oct. 6, 1997 (GB) ..... 9721155

(51) Int. Cl.[7] ..... F02B 57/00

(52) U.S. Cl. ..... 123/44 D; 123/44 R; 123/44 C; 475/14

(58) Field of Search ..... 123/44 D, 44 R, 123/44 C; 475/14

(56) References Cited

U.S. PATENT DOCUMENTS 2,242,231 A * 5/1941 Cantoni ..... 123/44 D
2,273,900 A * 2/1942 Sklenar ..... 123/44 D
2,683,422 A 7/1954 Richards, Jr. ..... 123/44 R
3,200,797 A 8/1965 Dillenberg ..... 123/44 D
3,517,651 A 6/1970 Graybill ..... 123/44 R
4,010,719 A * 3/1977 Lappa ..... 123/44 D
4,038,949 A * 8/1977 Farris ..... 123/44 D
4,062,330 A * 12/1977 Billings ..... 123/44 R
4,136,646 A * 1/1979 Lappa ..... 123/44 D
5,221,237 A * 6/1993 Weber ..... 475/14
5,365,892 A * 11/1994 Kienle ..... 123/44 D
5,720,241 A * 2/1998 Gail ..... 123/44 C

FOREIGN PATENT DOCUMENTS

WO WO 87/03042 * 5/1987
WO WO 98/11343 * 6/1993

* cited by examiner

*Primary Examiner*—Thai-Ba Trieu
(74) *Attorney, Agent, or Firm*—King & Schickli, PLLC

(57) ABSTRACT

A rotary two-stroke engine including a multi-cylinder block rotatably mounted on two main bearings within an engine housing, a crankshaft journalled for rotation within said main bearings, indirectly geared at a ratio of 2:1 to said cylinder block and piston members connected to said crankshaft which induce gas through ports in said cylinders via side entry tracts in said engine housing, being sealed by rotating seal rings.

19 Claims, 21 Drawing Sheets

ROTARY TWO-STROKE ENGINE

FIELD OF THE INVENTION

This invention relates to motors of the rotary piston type including a cylinder block rotatably mounted within an engine housing, containing a plurality of cylinders that vary in volume, in sequence, in response to the relative movement between the piston members and the cylinders. The motor may be in the form of an internal combustion engine, a hydraulic pump or motor, a pneumatic motor or compressor or a steam engine of the rotary type.

BACKGROUND ART

There have been proposed numerous constructions of motors wherein the relative movement between the piston members and the engine housing is rotational and employing the two-stroke cycle of operation. However, the strength of the crankshaft, the side thrust loads on the pistons and the port timing have all been compromised. In addition, it is necessary to address and keep to a minimum the pollution created by the engine.

Three particularly relevant patents which illustrate the nature of the motor or engine under consideration are U.S. Pat. No. 2,683,422 (A. Z. Richards Jnr.), U.S. Pat. No. 3,200,797 (Dillenberg) and U.S. Pat. No. 3,517,651 (Graybill). The entire disclosure and drawings of these three U.S. Patents is incorporated herein by cross reference.

DISCLOSURE OF THE INVENTION

It is therefore an objective of this invention to provide a two-stroke motor of the rotary piston type which addresses one or more of the previously mentioned problems.

According to the present invention there is provided a motor of the rotary piston type including a cylinder block rotatably mounted within an engine housing, a crankshaft journalled for rotation within said engine housing, piston members rotatably supported on said crankshaft for rotary motion within said cylinder block as said crankshaft and said cylinder block rotate and a plurality of cylinders arranged to define chambers between said cylinders and said piston members that vary in volume, in sequence, in response to the relative movement between said piston members and said cylinders.

The engine housing is formed by peripheral spacers and opposed end casings, with the cylinder block supported on the crankcase for rotational movement and the crankcase supported on two main bearings, one on each of the respective end casings.

The piston may have a hollow tubular rod portion, sealed by a set screw in the piston crown, extending through a gas seal and an oil seal, to be attached to the crankshaft bearing. The crankshaft may be indirectly connected to the crankcase by epicyclic gears of a 2:1 ratio. Two complete revolutions of the crankshaft cause one complete revolution of the cylinder block in the same direction.

By providing running clearance between the big-end of the connecting rod and the crankcase guides, torsional stress on the crankshaft is reduced.

Variable timing of the induction and/or transfer phases permit the engine to perform at its peak efficiency over a wide range of engine speeds.

The variable flow cooling system permits the engine to operate at its ideal temperature under extreme conditions.

The passing of pure air through the cylinder after combustion, returning unused fuel/air mixture to the inlet tract and closing the exhaust passage before the fresh fuel/air mixture enters the cylinder minimizes pollution of the atmosphere.

BRIEF DESCRIPTION OF THE DRAWINGS

Embodiments of the present invention will be more readily understood with reference to the following description of an internal combustion engine incorporating the present invention, as illustrated in the accompanying drawings, wherein.

MODES FOR CARRYING OUT THE INVENTION

Figure 1:
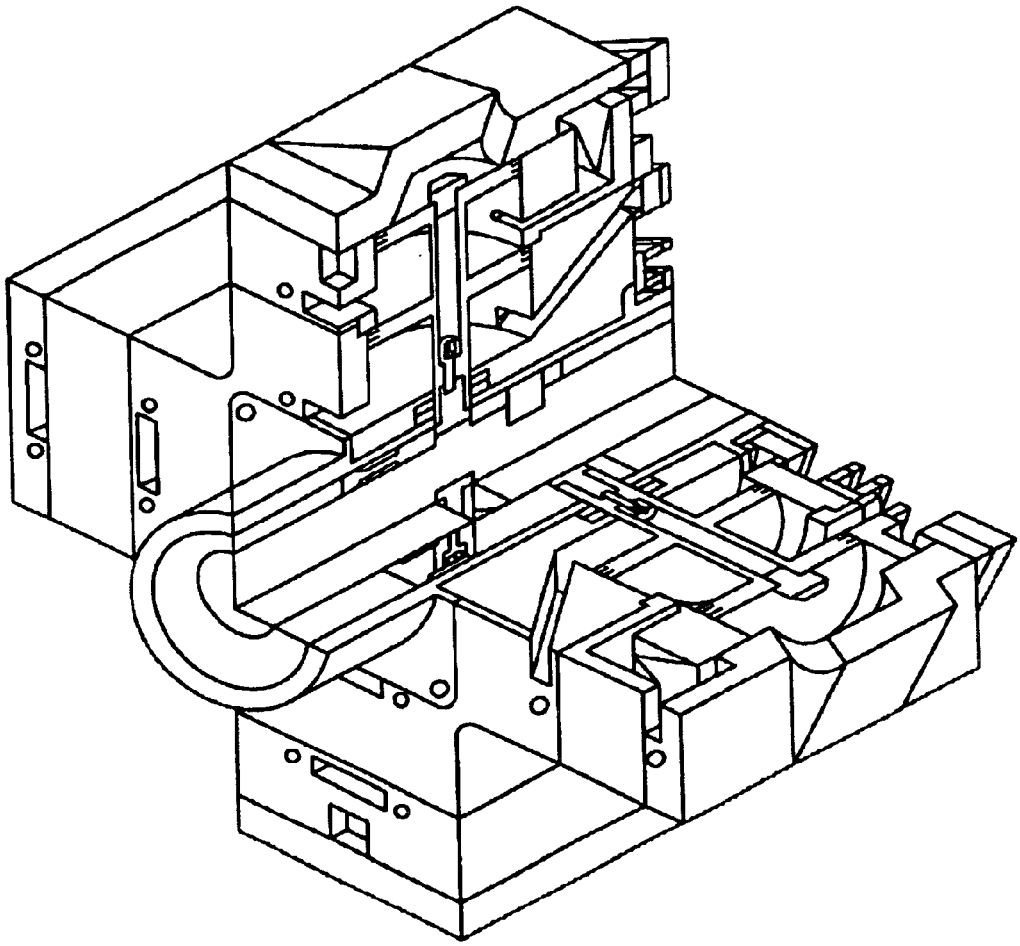
FIG. 1 is a perspective, part section view of the rotary two-stroke engine.

With reference to FIGS. 1 to 5 inclusive, an engine 1 comprises ideally an engine housing 3 comprised of two end casings 7A and 7B held rigidly together by engine bolts 10 and spacers 11, supporting two main bearings 25A and 25B within which rotates a crankshaft 20 having crankpins 21A and 21B and upon which rotates a crankcase 6 comprised of halves 6A and 6B, which are attached to the cylinder block 2 comprising two pairs of opposed cylinders 4 located radially at right-angles to each other. Connecting rods 30 may be bolted to big-end bearing carriers 96 by internal bolts 27, being sealed by set-screws 32 in the crowns of the pistons 31. The pistons 31 and connecting rods 30 co-act to cause rotation of the cylinder block 2 and the crankshaft 20 via the crankpins 21A and 21B with respect to the engine housing 3. The crankshaft 20 is mounted securely in the engine housing 3 by the main bearings 25A and 25B allowing the crankshaft 20 to rotate but to remain at all times in the same relative position with respect to the common centre of the cylinder axes.

The epicyclic gears 5 are of a 2:1 ratio and comprise the crankshaft gear 22, the crankcase gear 23 and two "piggy-back" idler gears 24A and 24B. They place the crankcase 6 in positive rotary engagement with the crankshaft 20 permitting 360 degrees rotation of the crankshaft 20 to result in 180 degrees rotation of the cylinder block 2.

The engine 1 may be air and/or liquid cooled.

Figure 2:
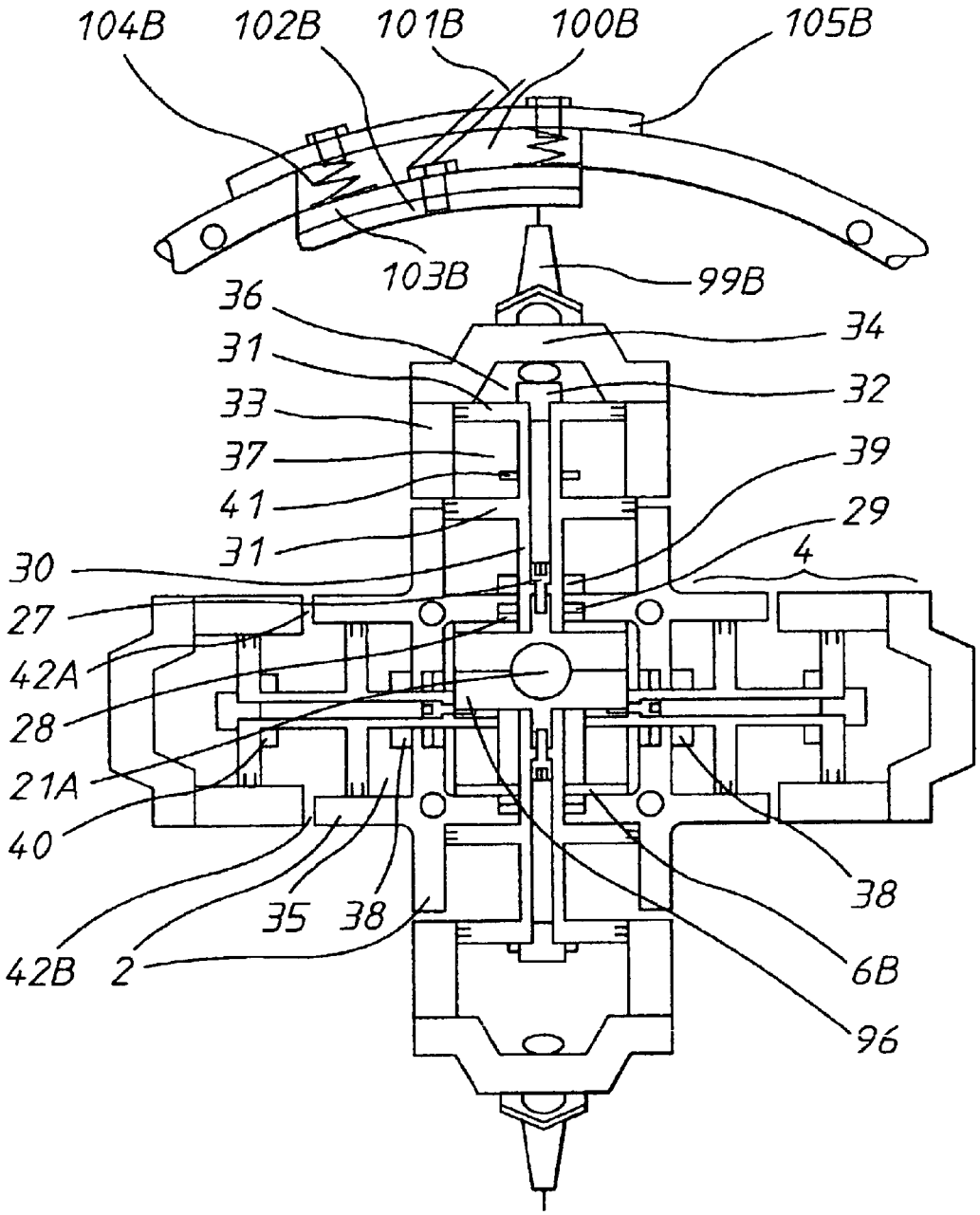
FIG. 2 is a cross section view through the engine of FIG. 1.

With particular reference to FIG. 2, the cylinders 4 have been drawn sectioned for explanatory purposes even though the opposing pairs of cylinders are staggered with respect to each other, as illustrated in FIG. 1. Induction is accomplished by the underside of the piston 31 drawing gas into the induction chamber 35 through the inlet port 38 when it is in line with the inlet tract 82. As the cylinder block 2 rotates in a clockwise direction and the piston 31 reaches T.D.C. the inlet port 38 is closed by the blank part of the inlet timing ring 90 pressing against the cylinder-side inlet seal ring orifice 44.

As the cylinder block 2 continues to rotate, the gas under the piston 31 is forced through the transfer port 39 into the transfer tract 83, then through the transfer joining tube 15 to the transfer plate transfer orifice 65. As the outer port 40 passes the transfer plate transfer orifice 65, the gas enters the outer cylinder 33.

In the power chamber 36, the gas is compressed and as the piston 31 approaches T.D.C. the spark plug 99 is timed to ignite the mixture. The power stroke continues until the outer port 40 is uncovered by the piston 31, allowing the exhaust gas to escape through the outer seal ring orifice 48 which is now in line with the exhaust plate orifice 70. The outer cylinder 33 is then opened to atmosphere via the reed valve 98 and the air choke 117, purging it of any residual exhaust gas. The transfer plate transfer orifice 65 opens after the exhaust plate orifice 70 has closed, allowing the fresh gas to enter the outer cylinder 33 but preventing any of the fuel/air mixture from escaping through the exhaust pipe 77. The gas is then compressed by the piston 31 in preparation for the next power stroke.

The piston 31 may be cooled internally by the air ports 42A and 42B in the cylinder 4 allowing cooling air to pass through the ancillary chamber 37.

The compressed fuel/air mixture is ignited in the outer cylinder 33 by a spark plug 99 being in rotary, conductive communication with a high tension lead 101 via an ignition strip 102. Pressure springs 104 maintain electrical contact between the top of the spark plug 99 and the ignition strip 102 which is insulated from the H.T. housing 100 by an insulating pad 103. The assembly is retained by a retaining plate 105. The ignition strip 102 is chamfered on its leading edge so that when the cylinders 4 expand, the top of the spark plug 99 pushes the ignition strip 102 against the pressure springs 104 into the cavity in the H.T. housing 100 without jamming. One high tension lead 101 is required for each ignition strip 102 due to the staggered cylinders 4, requiring them to be independently sprung. The length of the ignition strip 102 permits the required ignition advance. The ignition timing may be controlled from a separate shaft suitably geared to the engine 1 or from pick-ups located on the cylinder block 2.

Figure 3:
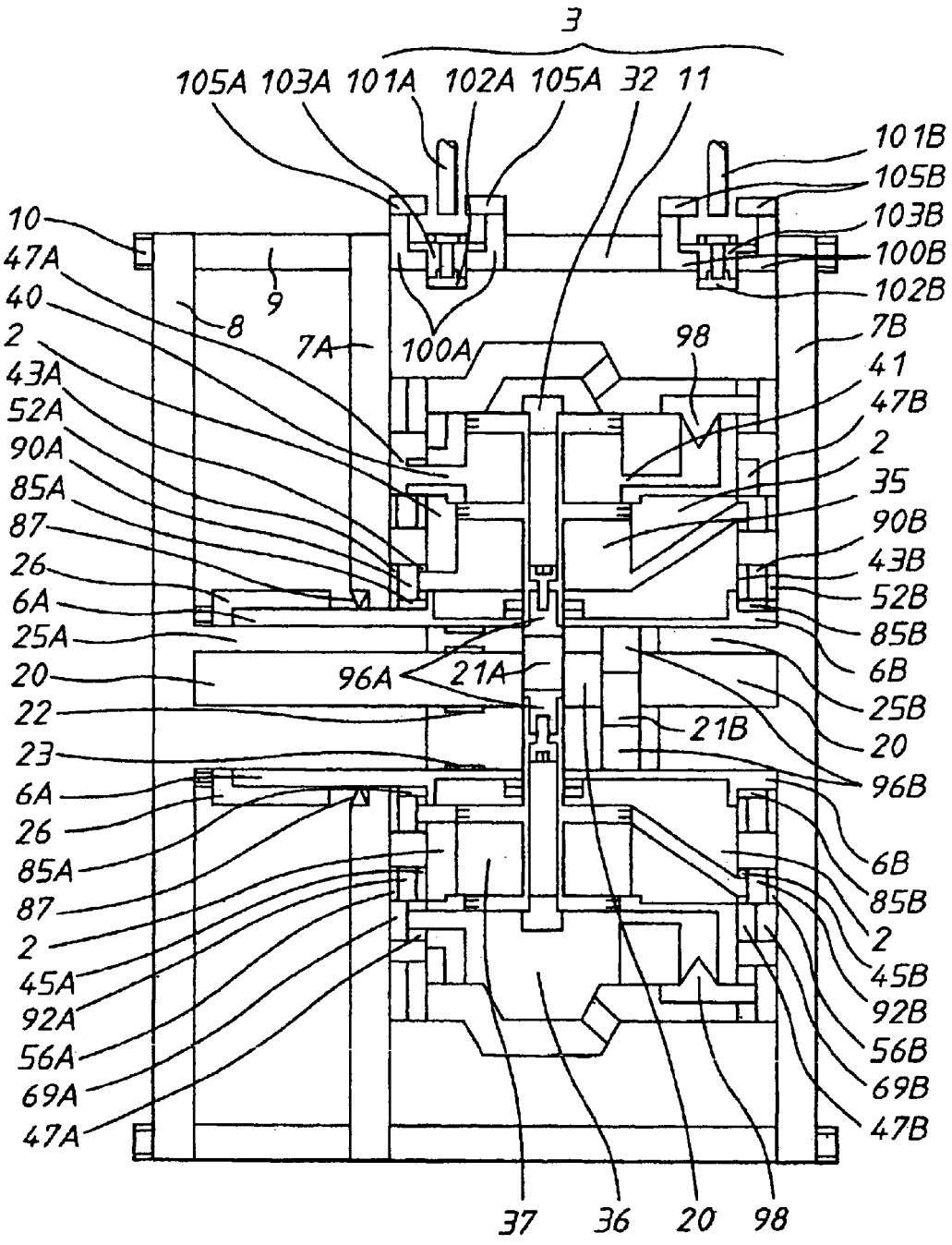
FIG. 3 is a vertical section view through the engine of FIG. 1.
Figure 4:
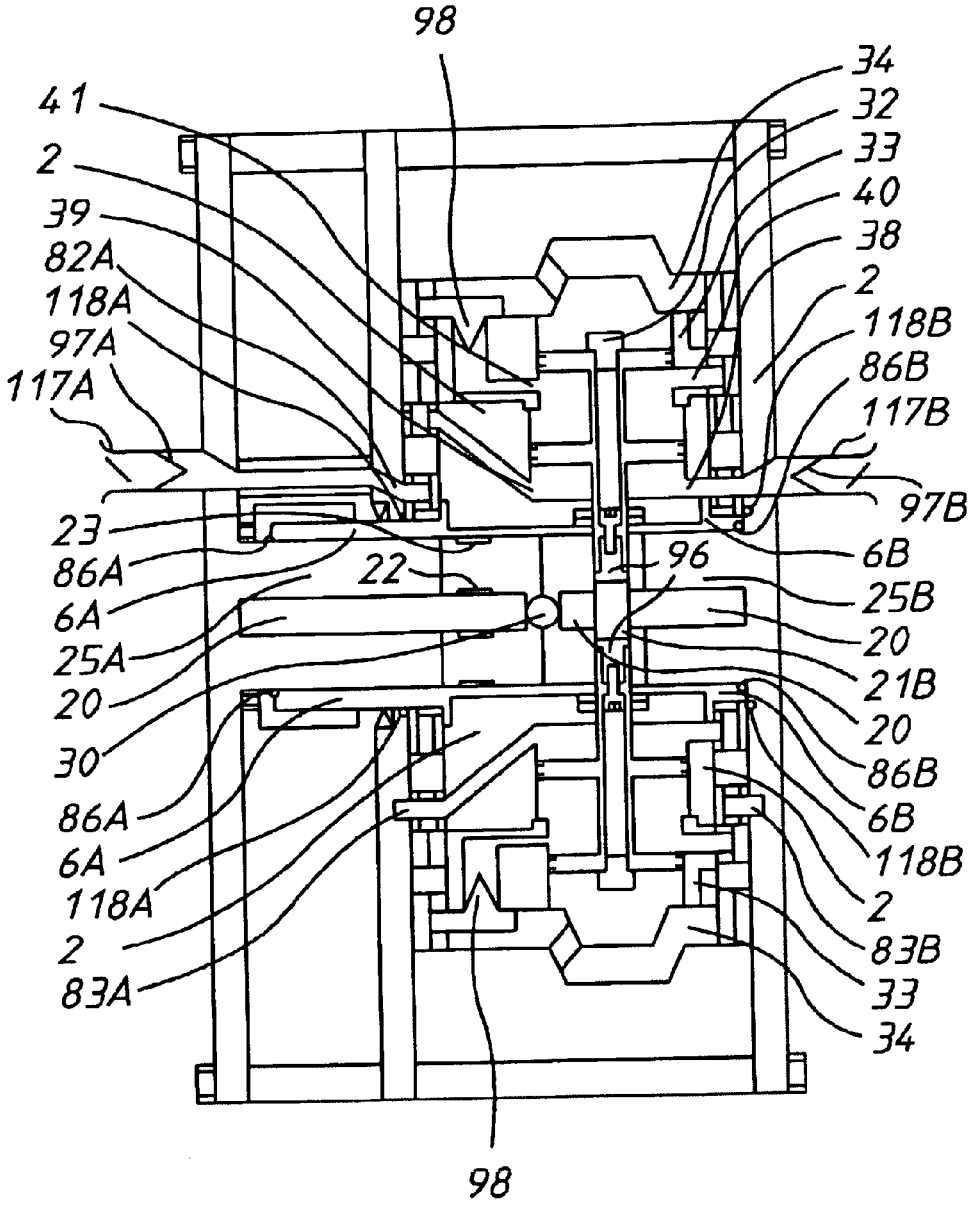
FIG. 4 is a horizontal section view through the engine of FIG. 1.
Figure 5:
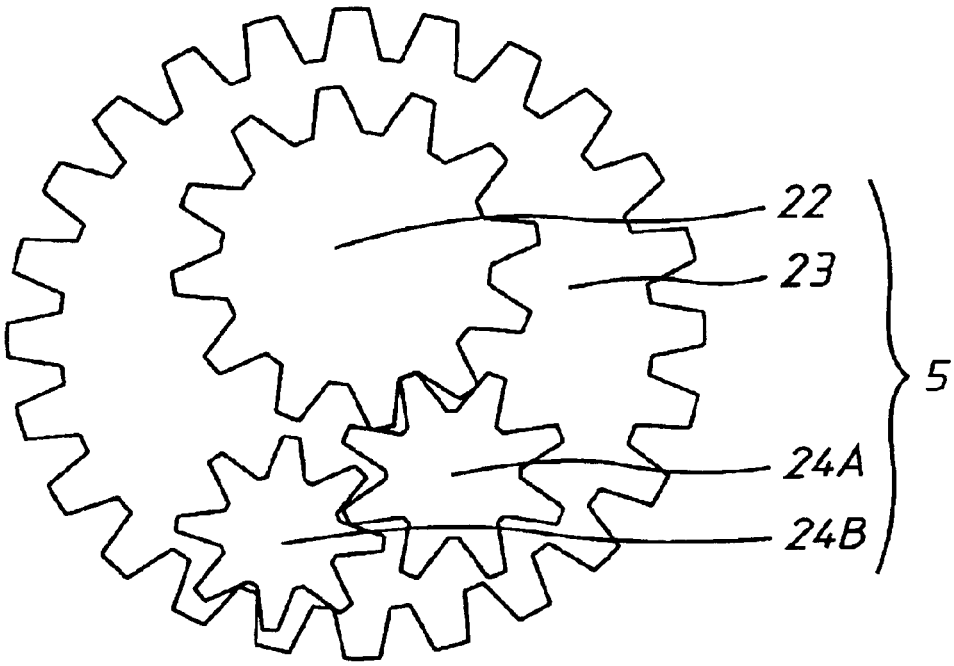
FIG. 5 is a cross section view of the epicyclic gears.

With particular reference to FIGS. 3 and 4, the driving gear 26 may be bolted to the crankcase 6A and held by a keyway (not shown). The engine oil may drain through the crankcase 6 and/or the cylinder block 2 into the oil drain tracts 85A and 85B and then into the end casings 7A and 7B to return to the tank via internal oilways or external pipes (not shown). The drive-side main bearing 25A may be supported by a separate plate 8 attached to the end casing 7A by the engine bolts 10 and spacers 9 allowing clearance for the driving gear 26 and the timing control mechanisms shown in FIGS. 17, 19, 21, and 23. By extending the crankshaft 20 to protrude beyond the end casings 7A and 7B, modules of the engine 1 may be connected together.

Figure 9:
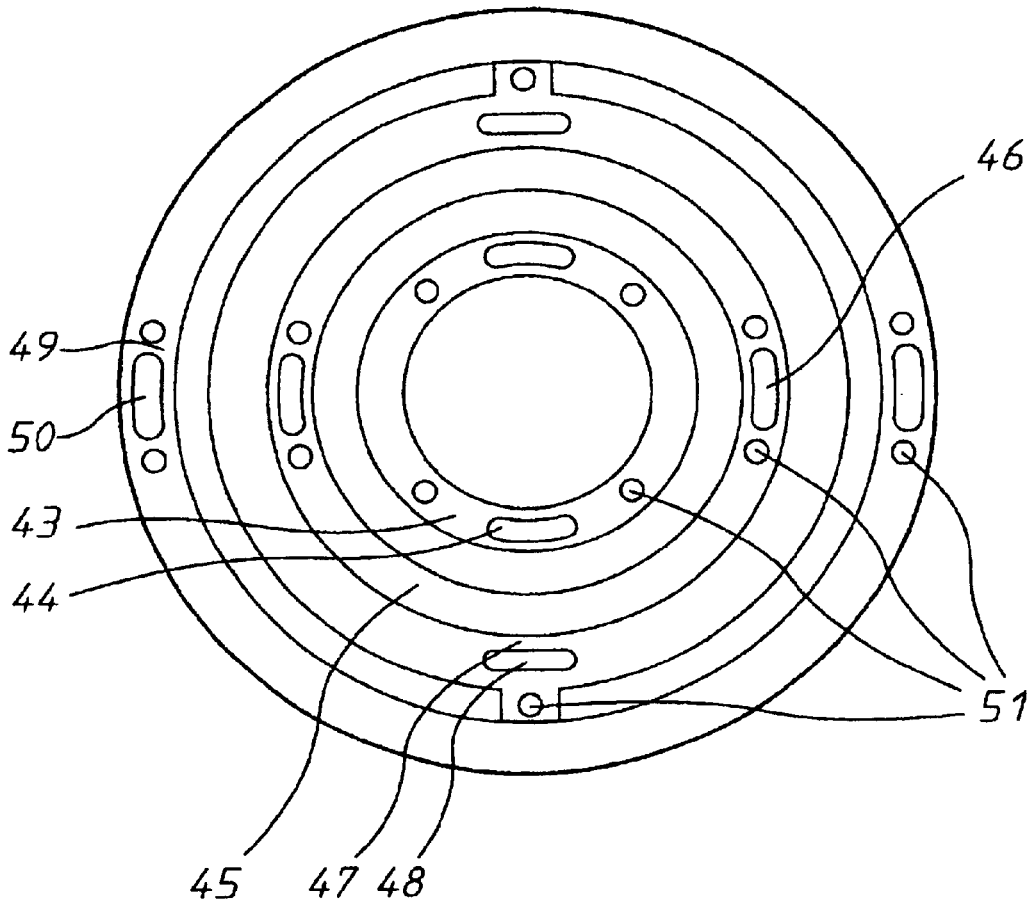
FIG. 9 is a view of the cylinder-side seal rings.

With reference to FIG. 9, between the casing side seal rings and the end casing 7, around each tract is a synthetic rubber "O" ring 88 settled partly into a groove 89 in the end casing 7 and pressing onto the back of the seal ring. Pressure upon assembly ensures that the seal ring is pressed firmly against its mating surface but not enough to close the gap around the synthetic rubber "O" ring 88 permitting the sealing function to be accomplished by the Teflon coated surface of the seal ring rubbing against its mating surface. The dowel pins ensure that each seal ring is always in line with its relative tract. Variations due to expansion upon warming-up and during the course of operation are accommodated by the synthetic rubber "O" rings behind the seal rings being compressible and the locating dowels being a sliding fit in their locating holes.

This sealing system may also be used on the inner cylinder ports whereby both seal rings would be floating. Each seal ring is a full circle ensuring contact at all times. The seal rings and the timing rings may be Teflon coated on their mating surfaces. They may be assisted by spring pressure.

Fuel and air communicate within the engine 1 via air chokes 117A and 117B, reed valves 97A and 97B, inlet tracts 82A and 82B, transfer tracts 83A and 83B, transfer joining tubes 15A and 15B, reed valve 98, air tubes 13A and 13B, pressure release tubes 18A and 18B, inlet port 38, transfer port 39, outer port 40 and air port 41. Fuel is combined with air via fuel injectors 116A and 116B.

Sealing mechanisms, as illustrated, include connecting rod oil seals 28 and gas seals 29, crankcase oil seals 86A and 86B, drive case oil seal 87, oil drain tract seals 118A and 118B and end casing tract "O" ring seals 88. Also included are casing-side inlet seal rings 52A and 52B, casing-side transfer seal rings 56A and 56B, casing-side air seal rings 60A and 60B, transfer plates 64A and 64B, exhaust plates 69A and 69B, cylinder-side inlet seal rings 43A and 43B, cylinder-side transfer seal rings 45A and 45B, outer seal rings 47A and 47B, cylinder-side air seal rings 49A and 49B, inlet timing rings 90A and 90B, transfer timing rings 92A and 92B and exhaust pipe rings 78.

Combustion gases enter the cylinder 4 via cylinder-side inlet seal ring orifices 44A and 44B, cylinder-side transfer seal ring orifices 46A and 46B, outer seal ring orifices 48A and 48B, cylinder-side air seal ring orifices 50A and 50B, casing-side inlet seal ring orifices 53A and 53B, casing-side transfer seal ring orifices 57A and 57B, casing-side air seal ring orifices 61A and 61B, transfer plate transfer orifices 65A and 65B and pressure release orifices 66A and 66B, inlet timing ring orifices 91A and 91B and transfer timing ring orifices 93A and 93B.

Exhaust gases pass out through outer port 40, outer seal ring orifice 48 and exhaust plate orifice 70 into exhaust pipe 77.

The relative positions of the cylinder-side seal rings may be maintained by counter-sunk screws. The end casings 7A and 7B have dowel holes 55, 59, 63, 68 and 74 which receive casing-side seal ring locating dowels 54, 58, 62, 67 and 73.

The timing rings 90 and 92 are permitted to rotate some degrees via the elongated slots 95 in the end casing 7 permitting movement of the retaining bars 94 being positioned by the control plates 1101 and 110T.

Note that gas passages in the end casings 7 are referred to as "tracts", in the cylinders 4 as "ports" and in the seal rings as "orifices". An "induction chamber" 35 is defined in the space between the base of the piston 31 and the cylinder block 2. An "ancillary chamber" 37 is defined in the space around the piston 31 between the larger diameter piston base and the smaller diameter outer cylinder 33. A "power chamber" is defined in the space between the crown of the piston 31 and the cylinder head 34.

Features of forms of the described arrangements include:

1. The timing of the inlet ports, transfer ports and outer ports is controlled by the position of the cylinder block and not by the piston itself.
2. The transferred gas enters the outer cylinder via the outer port so a floating transfer plate is required. The transfer orifice may be joined to the transfer tract via a flexible tube connected between the transfer plate and the end casing.
3. Any unused fuel/air mixture is returned to the incoming charge because the pressure release orifice is joined to the inlet tract via a separate pipe.
4. The big-end of the connecting rod runs in guides in the crankcase reducing the torsional loads on the crankshaft.
5. The crankshaft is indirectly geared to the crankcase via two "piggy-back" idler gears. This permits the crankshaft to be made larger in diameter for increased strength whilst maintaining the correct direction of rotation relative to the crankcase.
6. The positive gearing between the crankcase and the crankshaft reduces the side thrust between the piston and the cylinder during rotation under operating conditions, reducing wear and friction.
7. The swept volume of the induction chamber may be made equal to the swept volume of the power chamber by increasing the bore of the inner cylinder to compensate for the volume of the connecting rod. A larger capacity induction chamber would supercharge the engine.
8. The ancillary chamber is open to atmosphere to reduce pumping losses and cool the piston internally.
9. Primary compression is increased due to the solid base of the piston meeting flush with the cylinder block at B.D.C.
10. Variations in running clearance due to expansion do not affect the sealing of the engine because the seal ring locating dowels are permitted to slide in their locating holes and the "O" ring seals are compressible.

Figure 6:
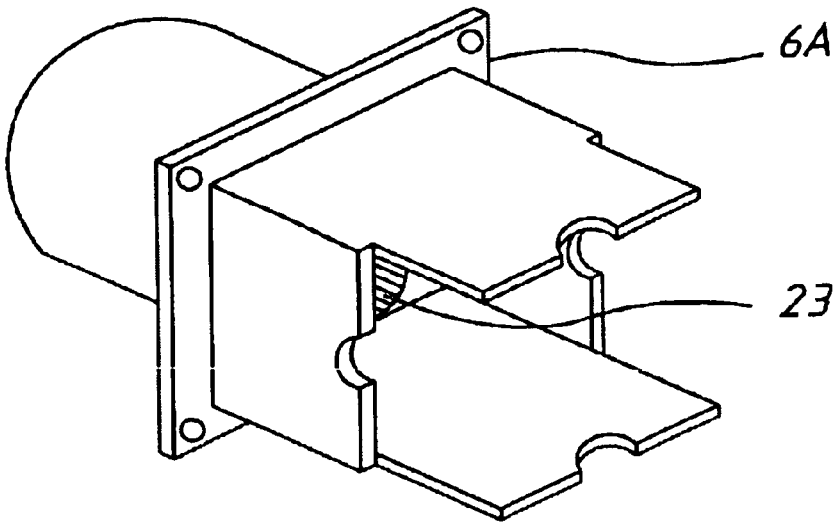
FIG. 6 is a perspective view of one of the crankcase halves.

FIG. 6 illustrates one of the crankcase halves 6A with the crankcase gear 23. The crankcase 6 is comprised of two halves 6A and 6B bolted to the cylinder block 2 to locate the inner oil seals 28 and the outer gas seals 29 around the connecting rods 30. The oil seals 28 and the gas seals 29 are positioned via recesses machined in the cylinder block 2.

Figure 7:
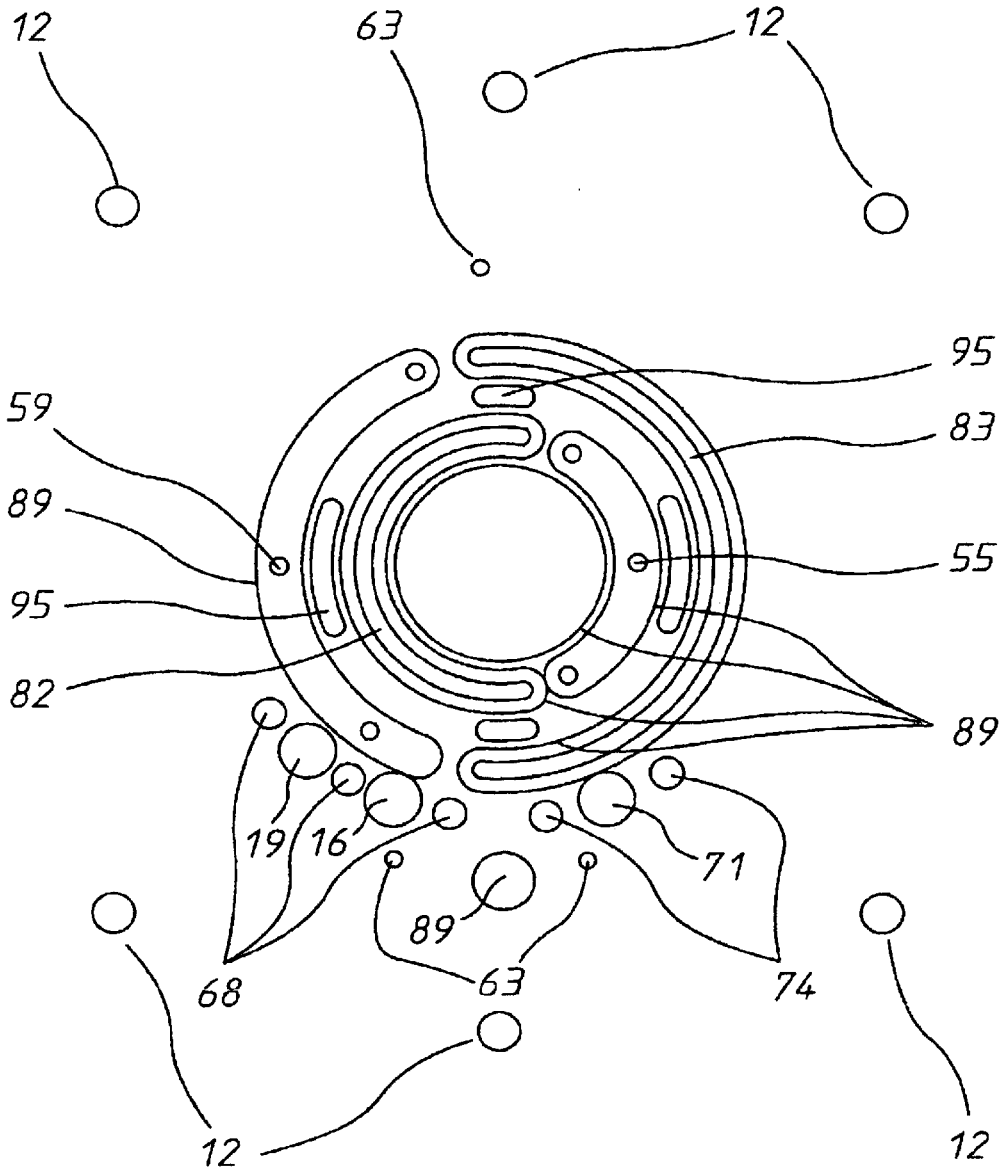
FIG. 7 is a view of one end casing with tracts and clearance holes.

FIG. 7 illustrates the respective positions of the exhaust plate clearance hole 71, dowel locating holes 55, 59, 63, 68 and 74, elongated timing ring slots 95, inlet tract 82, transfer tract 83, transfer joining tube clearance hole 16, pressure release tube clearance hole 19, engine bolt holes 12 and exhaust pipe bolt holes 80 in one end casing 7A. Around each tract is a groove 89 to locate the synthetic rubber "O" ring seal 88. The grooves 89 which do not enclose a tract locate a synthetic rubber "O" ring which acts as a spacing rubber to equalize the pressure on the seal ring around the whole of its surface area.

Figure 8:
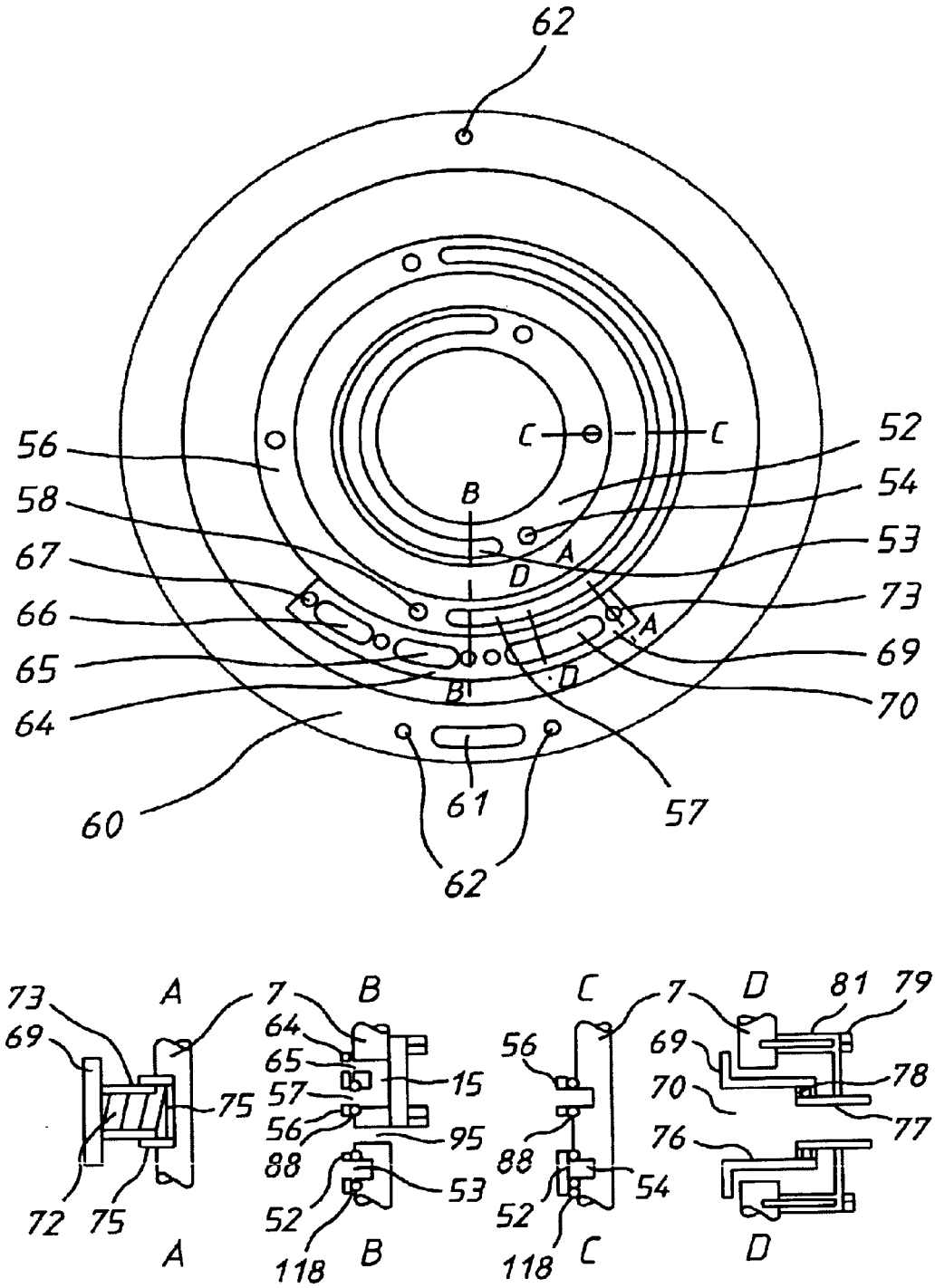
FIG. 8 is a view of the casing-side seal rings, exhaust plate and transfer plate.

FIG. 8 illustrates the respective positions of the casing-side inlet 52, transfer 56 and air 60 Teflon coated seal rings and the ceramic coated transfer 64 and exhaust 69 plates.

Section AA in FIG. 8 is a cross section of the exhaust plate 69 taken through one locating dowel 73, showing the heat resistant sleeve 75 and the pressure spring 72.

Section BB in FIG. 8 is a cross section of the casing-side inlet 52 and transfer 56 seal rings and the transfer plate 64 taken through the inlet 53, transfer 57 and transfer plate transfer 65 orifices. It also shows the synthetic rubber "O" ring seals 88, their locating grooves 89, the transfer joining tube 15 and the elongated slots 95 for the timing ring retaining bars 94.

Section CC in FIG. 8 is a cross section of the casing-side inlet 52 and transfer 56 seal rings taken through the locating dowel 54 and showing the synthetic rubber "O" ring seal 88 of the casing-side seal ring 56.

Section DD in FIG. 8 is a cross section of the exhaust plate 69 taken through the exhaust plate orifice 70. The exhaust plate 69 may be ceramic coated on its rubbing surface and positioned away from the end casing 7. The exhaust plate tube 76 is shown fitting over the exhaust pipe 77 being sealed by the exhaust pipe rings 78 which seal in the same way as piston rings. The exhaust pipe 77 may be attached to the end casing 7 by bolts 79 and heat resistant washers 81. There should be enough clearance between the exhaust pipe 77 and the end casing 7 to allow the free passage of cooling air and the contact area kept to a minimum to reduce heat transfer and distortion.

FIG. 9 illustrates the respective positions of the Teflon coated cylinder-side inlet 43, transfer 45 and air 49 seal rings showing the counter-sunk locating holes 51 and the ceramic coated outer seal ring 47. The cylinder-side inlet 43 and transfer 45 seal rings may be made together in one piece. The cylinder-side air seal ring 49 may incorporate the ring gear for the starter motor.

Figure 10:
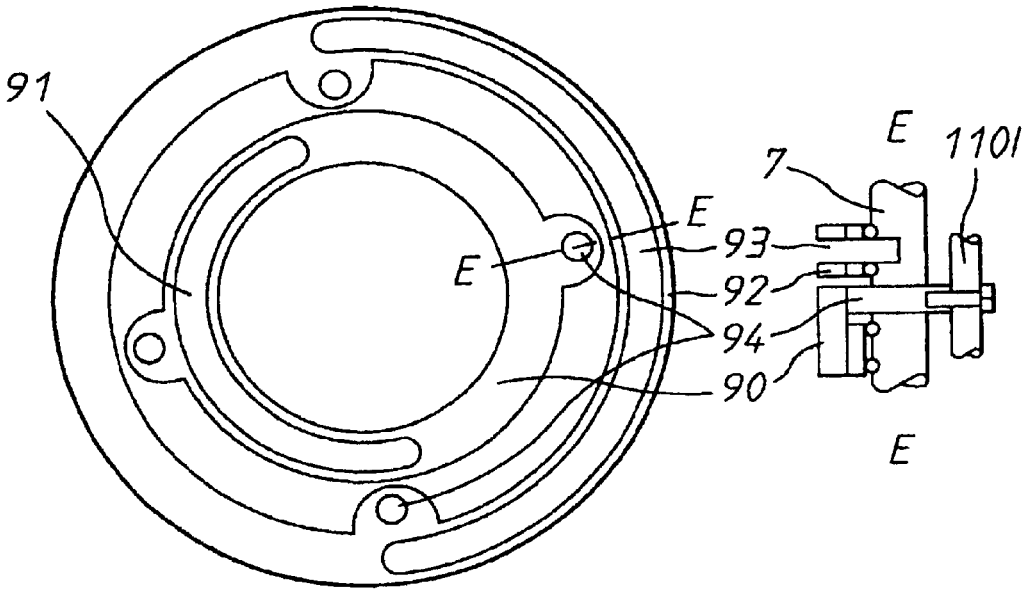
FIG. 10 is a view of the inlet and transfer timing rings with the locating bars.

FIG. 10 illustrates the timing rings 90 and 92 showing that their orifices 91 and 93 are shorter than the casing-side seal ring orifices 53 and 57 to permit their movement without compromising the gas flow.

Section EE in FIG. 10 is a cross section of the Teflon coated timing rings 90 and 92 taken through the transfer timing ring orifice 93 and the inlet timing ring retaining bar 94.

With particular reference to FIGS. 11 to 15 inclusive, progressive operational phases of the engine 1 will be described.

Figure 11:
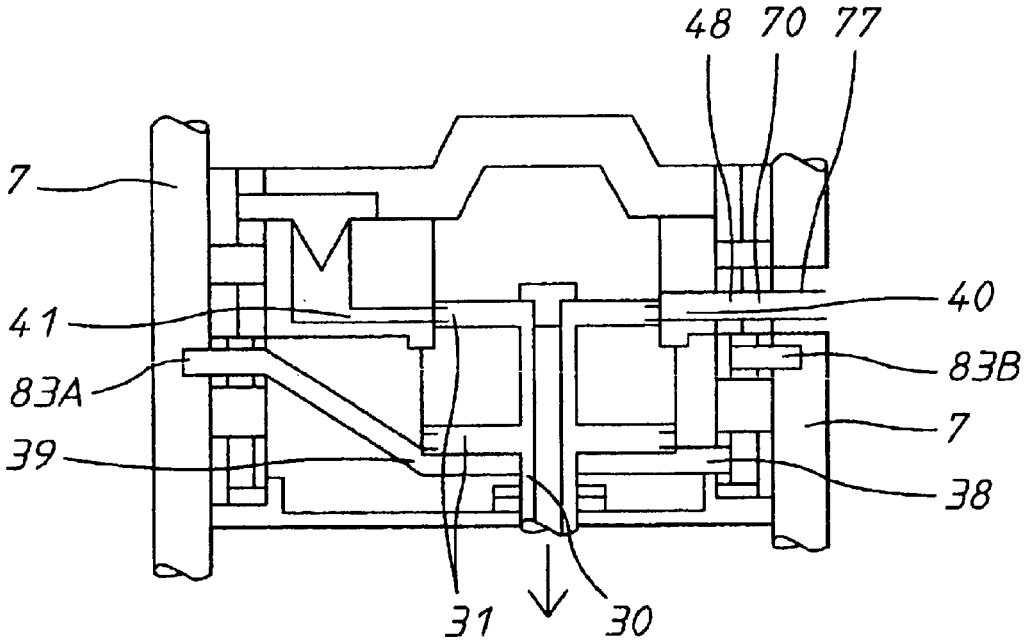
FIG. 11 is a side section view through one of the cylinders and ports of the engine of FIG. 1 illustrating a first position of operation.

FIG. 11 illustrates the piston 31 on the power stroke. The exhaust pipe 77 is already open to the outer port 40 by the exhaust plate orifice 70 aligning with the outer seal ring orifice 48. This is done before the piston 31 uncovers the outer port 40 so that the minimum restriction is offered to the exhausting gas. The underside of the piston 31 compresses the fresh charge into the transfer tract 83.

Figure 12:
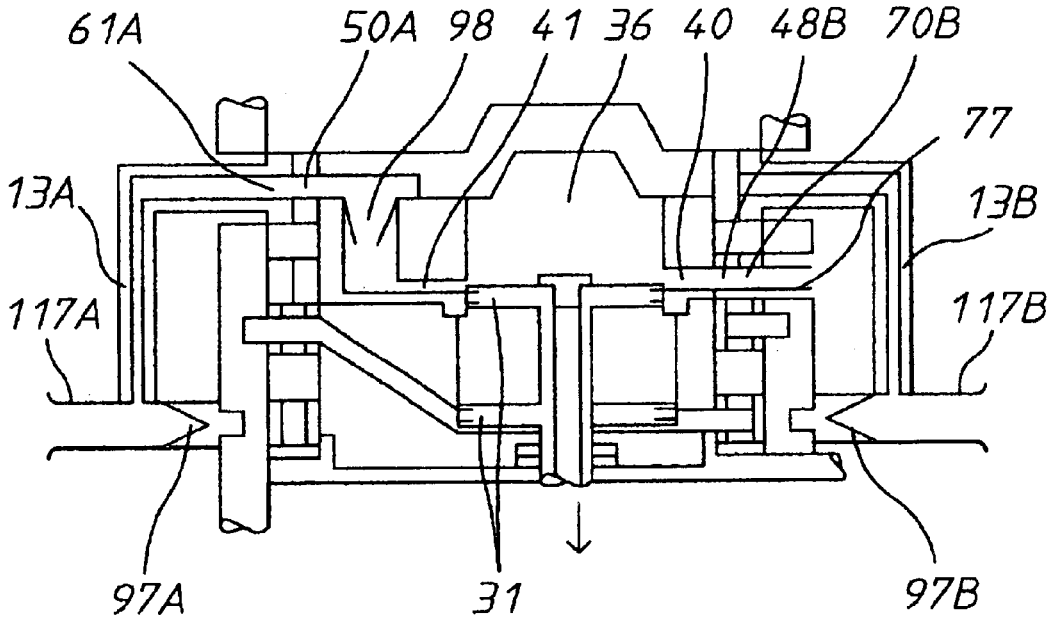
FIG. 12 is a view as for FIG. 11 illustrating a second position of operation.

FIG. 12 illustrates the piston 31 approaching B.D.C. after the high pressure exhaust gas in the outer cylinder 33 has been released through the exhaust pipe 77. The air port 41 is open to atmosphere via the reed valve 98 and the air choke 117 allowing fresh cold air to pass across the crown of the piston 31, having been induced into the outer cylinder 33 by the low pressure created by the exhausting gas, purging the power chamber 36 of any residual exhaust gas.

Figure 13:
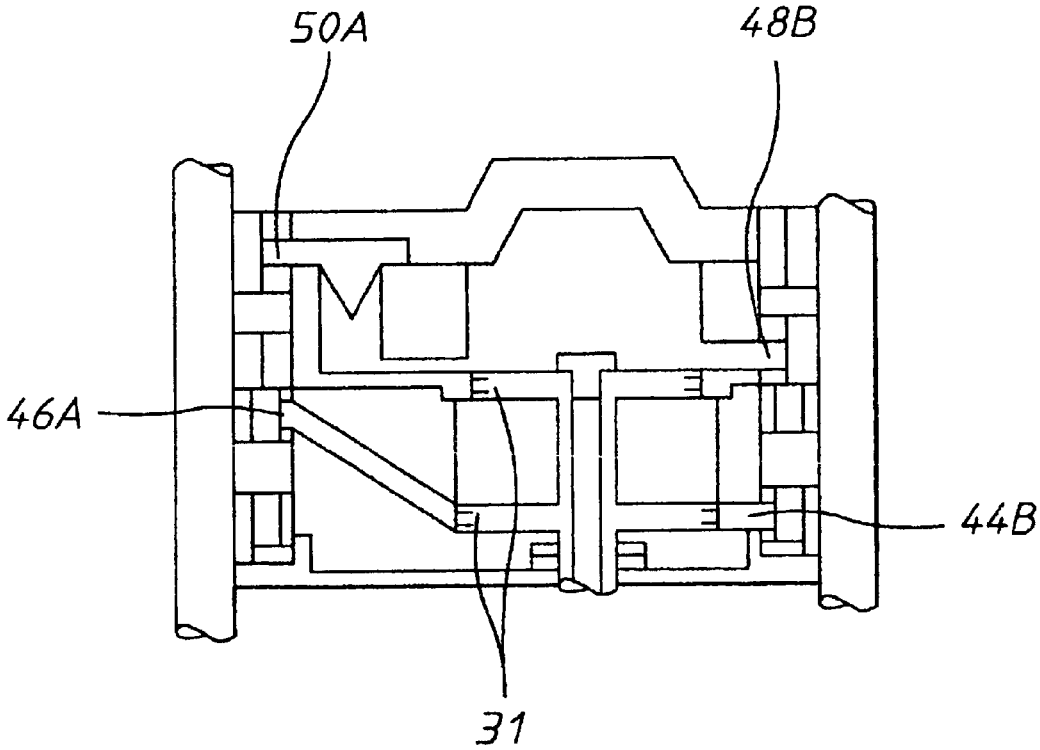
FIG. 13 is a view as for FIG. 11 illustrating a third position of operation.

FIG. 13 illustrates the piston 31 at B.D.C. when the cylinder-side inlet 44, transfer 46, outer 48 and air 50 seal ring orifices are all closed.

Figure 14:
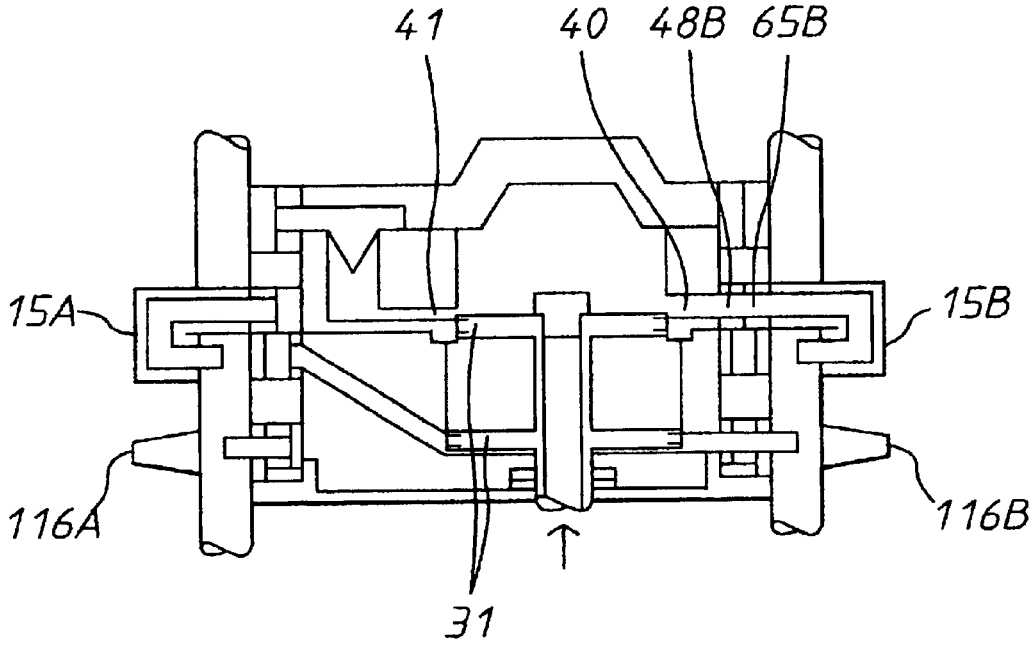
FIG. 14 is a view as for FIG. 1I illustrating a fourth position of operation.

FIG. 14 illustrates the piston 31 commencing the compression stroke. The transferred gas cannot escape to pollute the exhaust because the transfer plate transfer orifice 65 is not opened until the exhaust plate orifice 70 has closed. The underside of the piston 31 commences the induction stroke.

Figure 15:
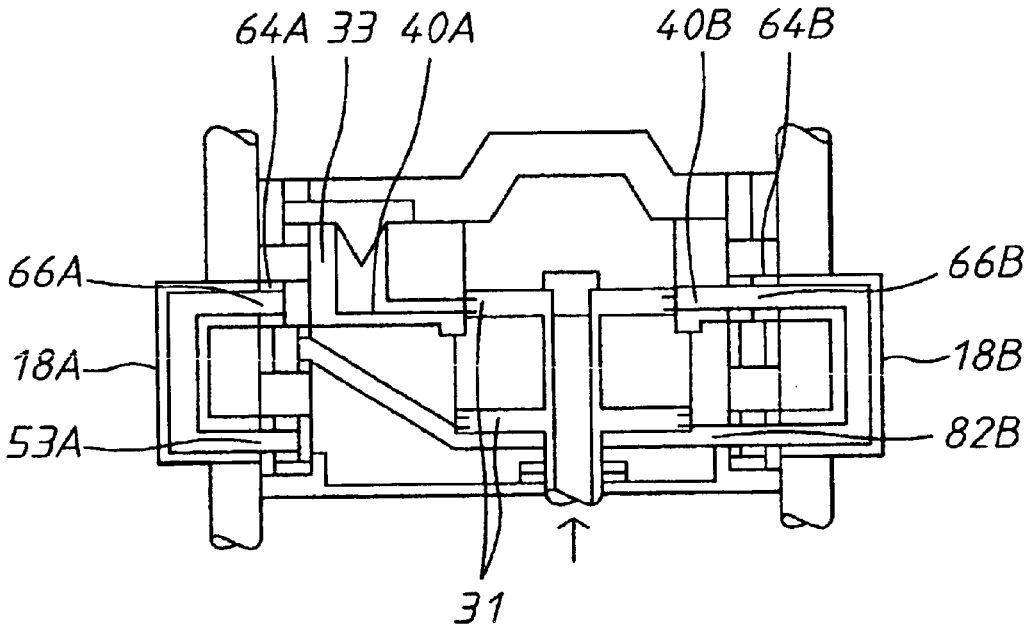
FIG. 15 is a view as for FIG. 11 illustrating a fifth position of operation.

With particular reference to FIG. 15, at low engine speeds there is enough time for all the transferred gas to enter the outer cylinder 33 before the piston 31 closes the outer port 40. At high engine speeds this critical time is reduced. Thus the pressure release orifices 66A and 66B in the transfer plates 64A and 64B open after the transfer plate transfer orifices 65A and 65B and the outer port 40 have closed. The pressure release tubes 18A and 18B allow any residual fresh charge which may be trapped in the outer port 40 to be returned to the inlet tracts 82A and 82B. Thus the next time the engine 1 is in the exhaust phase no residual fresh charge is left in the outer port 40.

Figure 16:
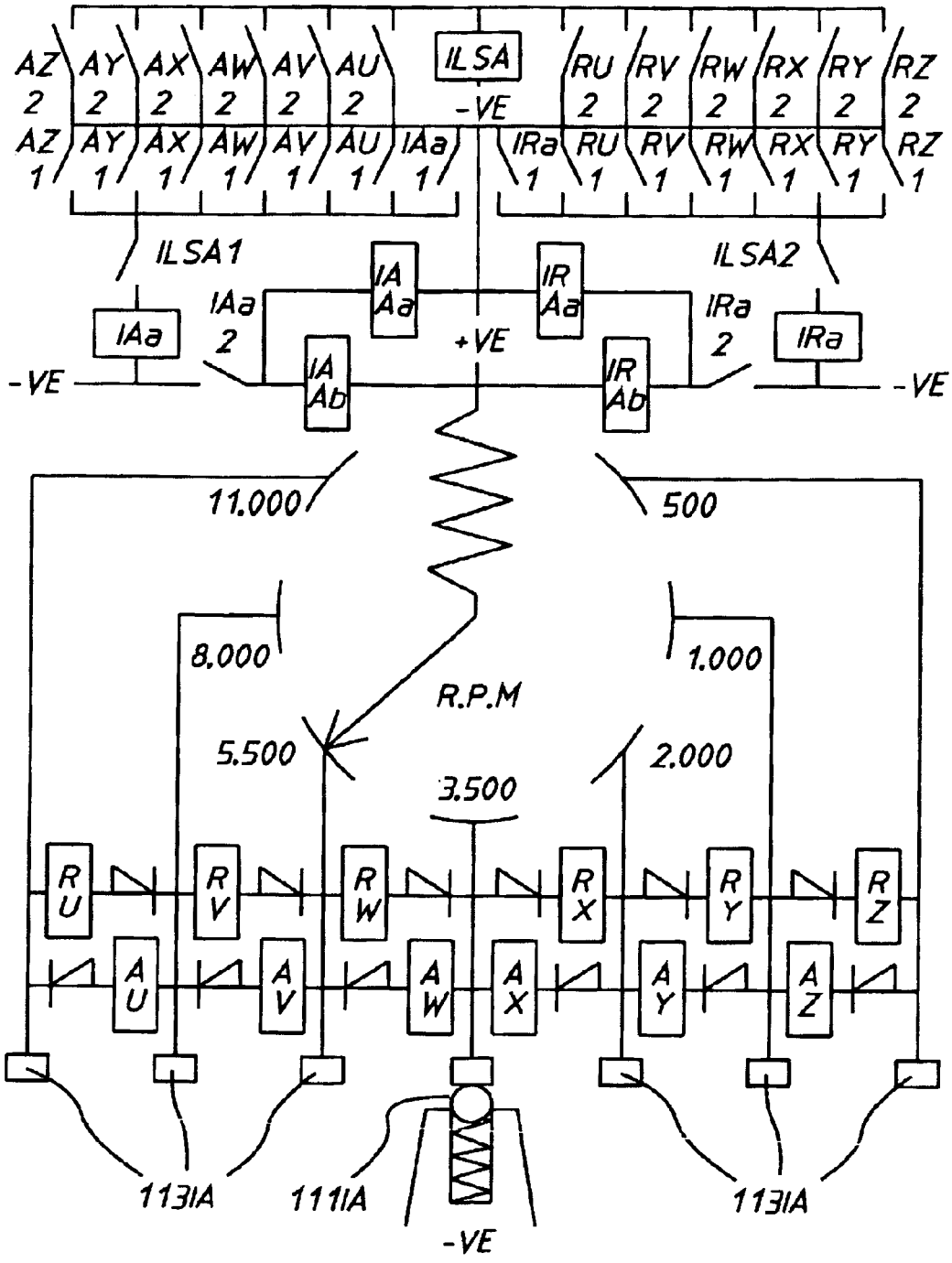
FIG. 16 is an electrical circuit to control the position of inlet timing ring "A".
Figure 17:
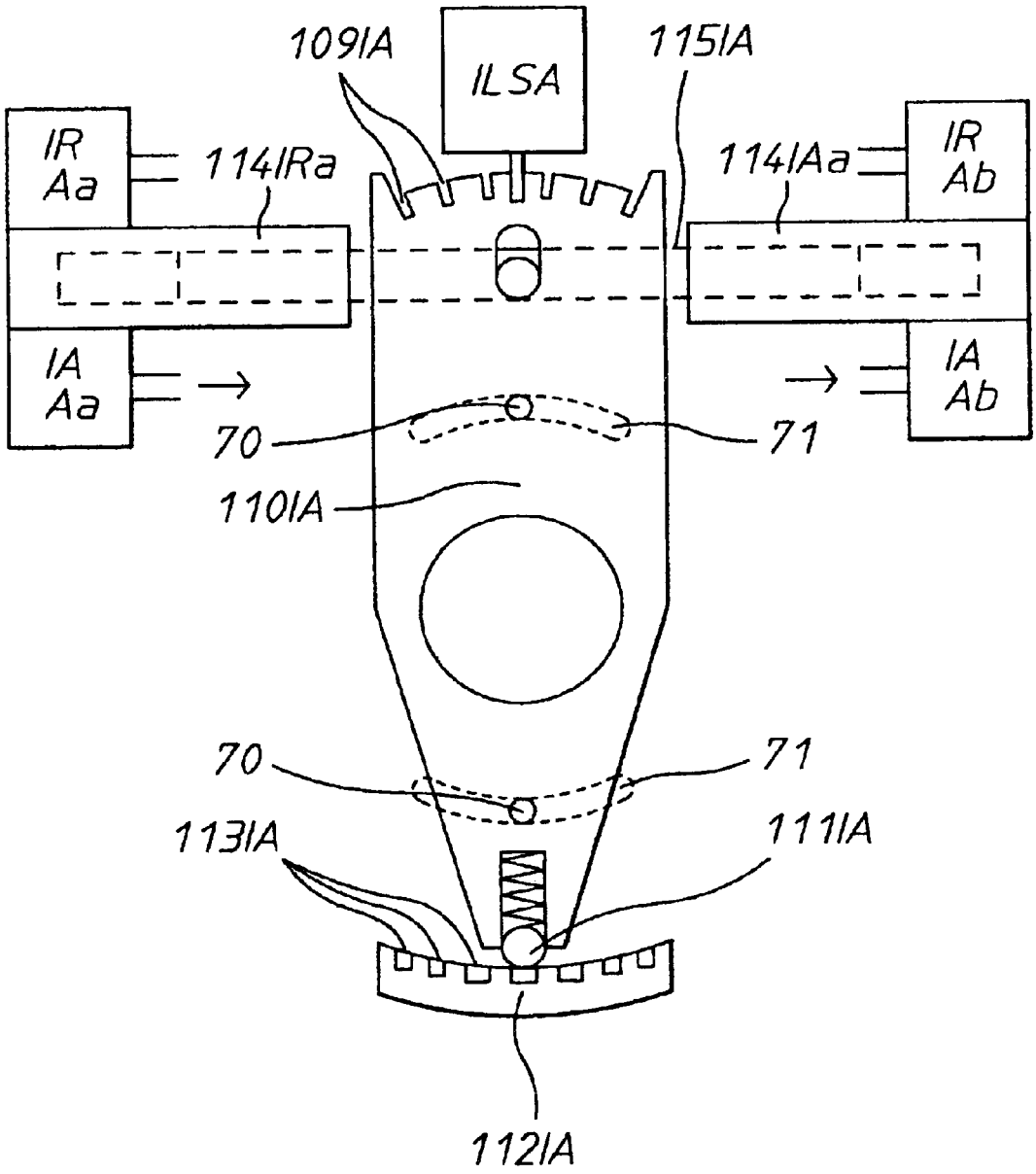
FIG. 17 is a view of the control mechanism for inlet timing ring "A".
Figure 20:
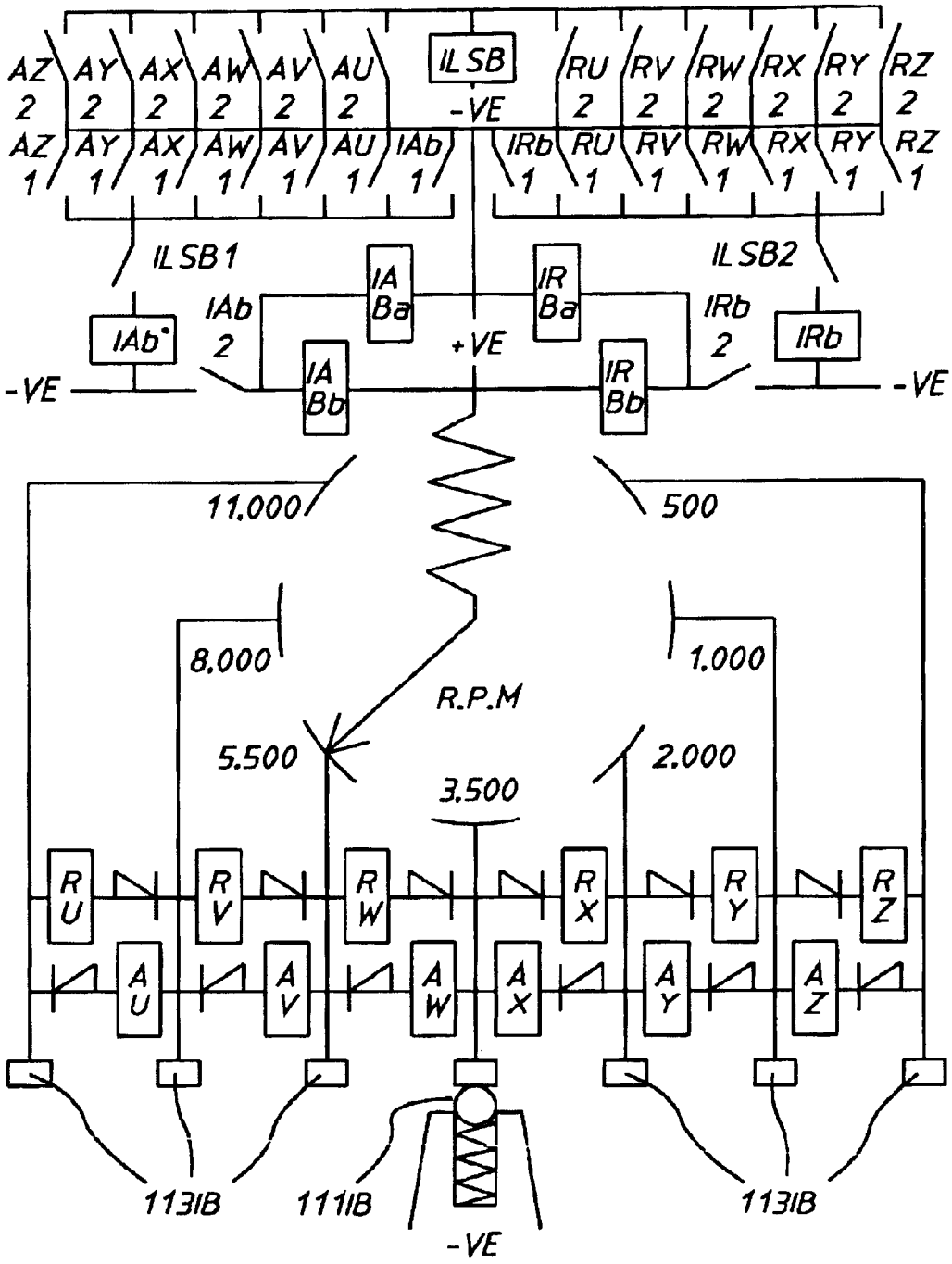
FIG. 20 is an electrical circuit to control the position of inlet timing ring "B".
Figure 21:
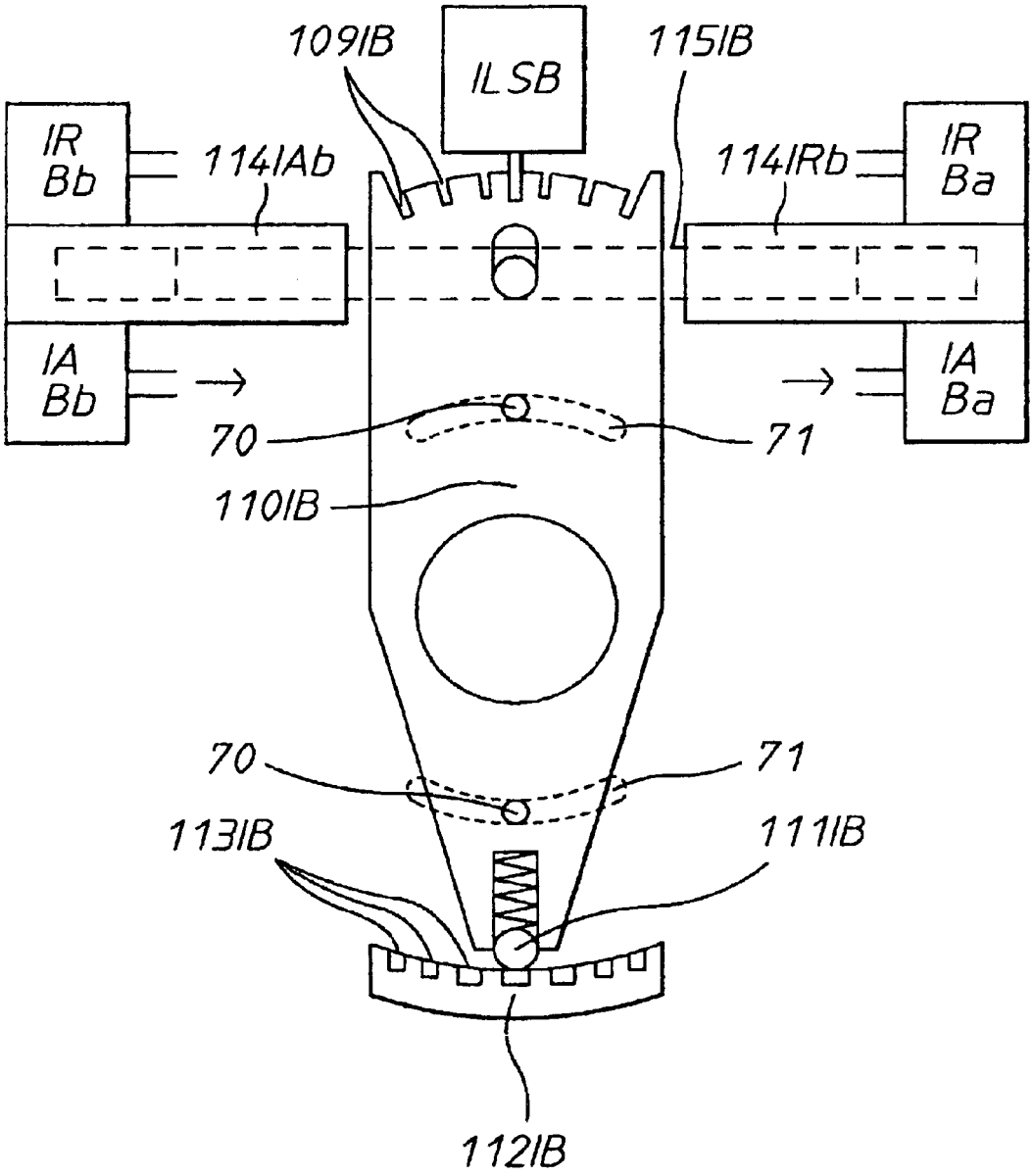
FIG. 21 is a view of the control mechanism for inlet timing ring "B".
Figure 22:
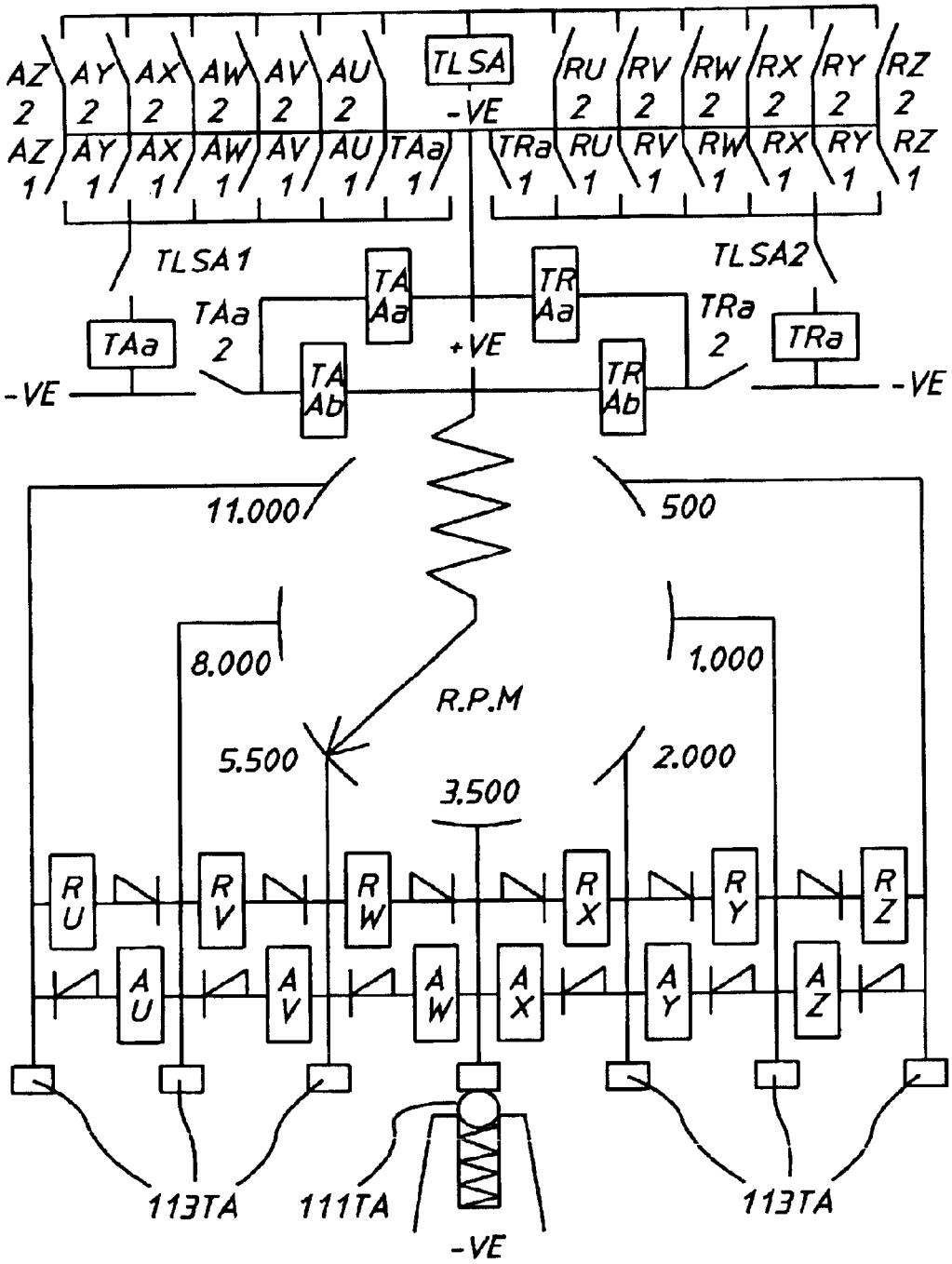
FIG. 22 is an electrical circuit to control the position of transfer timing ring "A".
Figure 23:
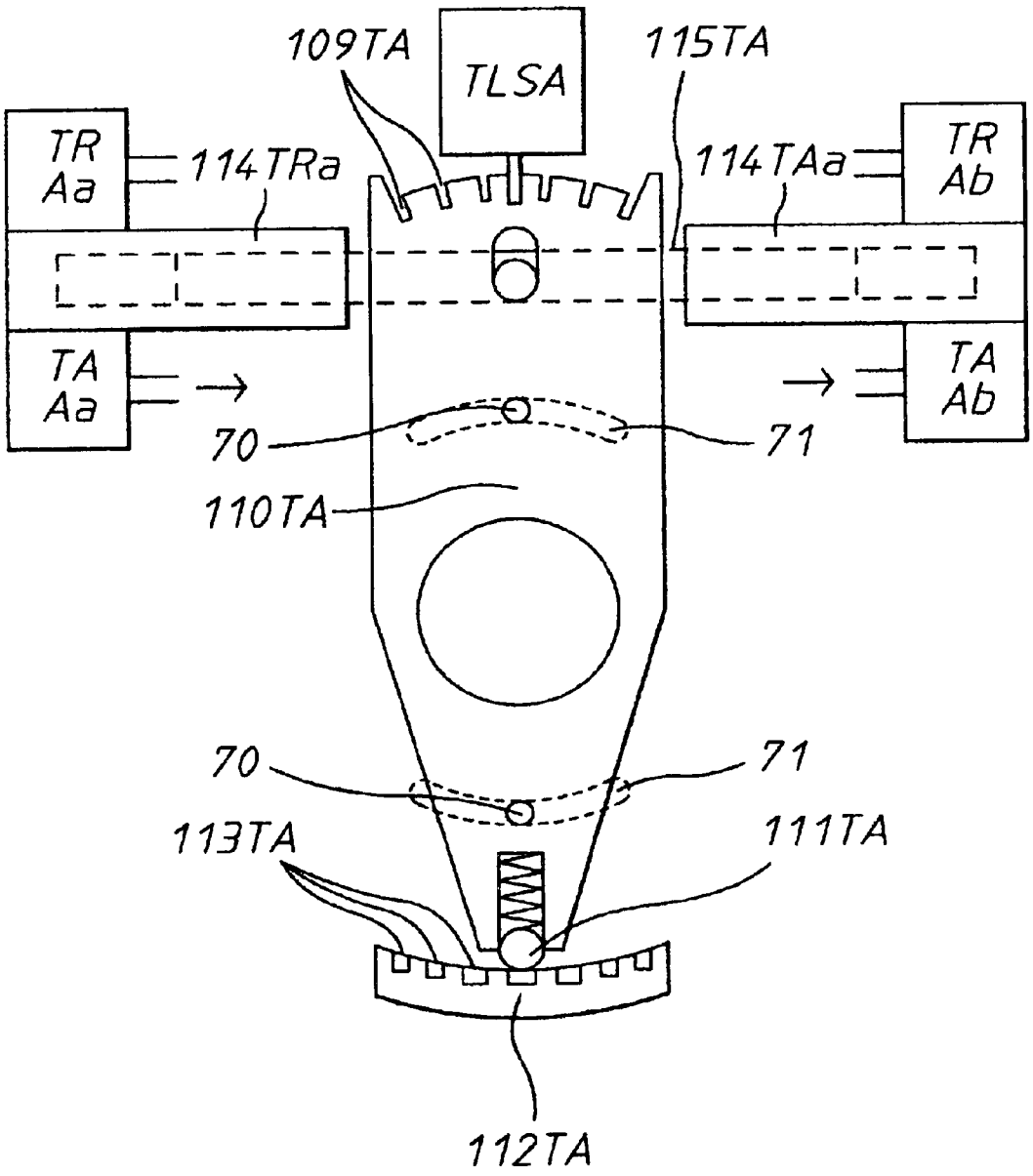
FIG. 23 is a view of the control mechanism for transfer timing ring "A".
Figure 24:
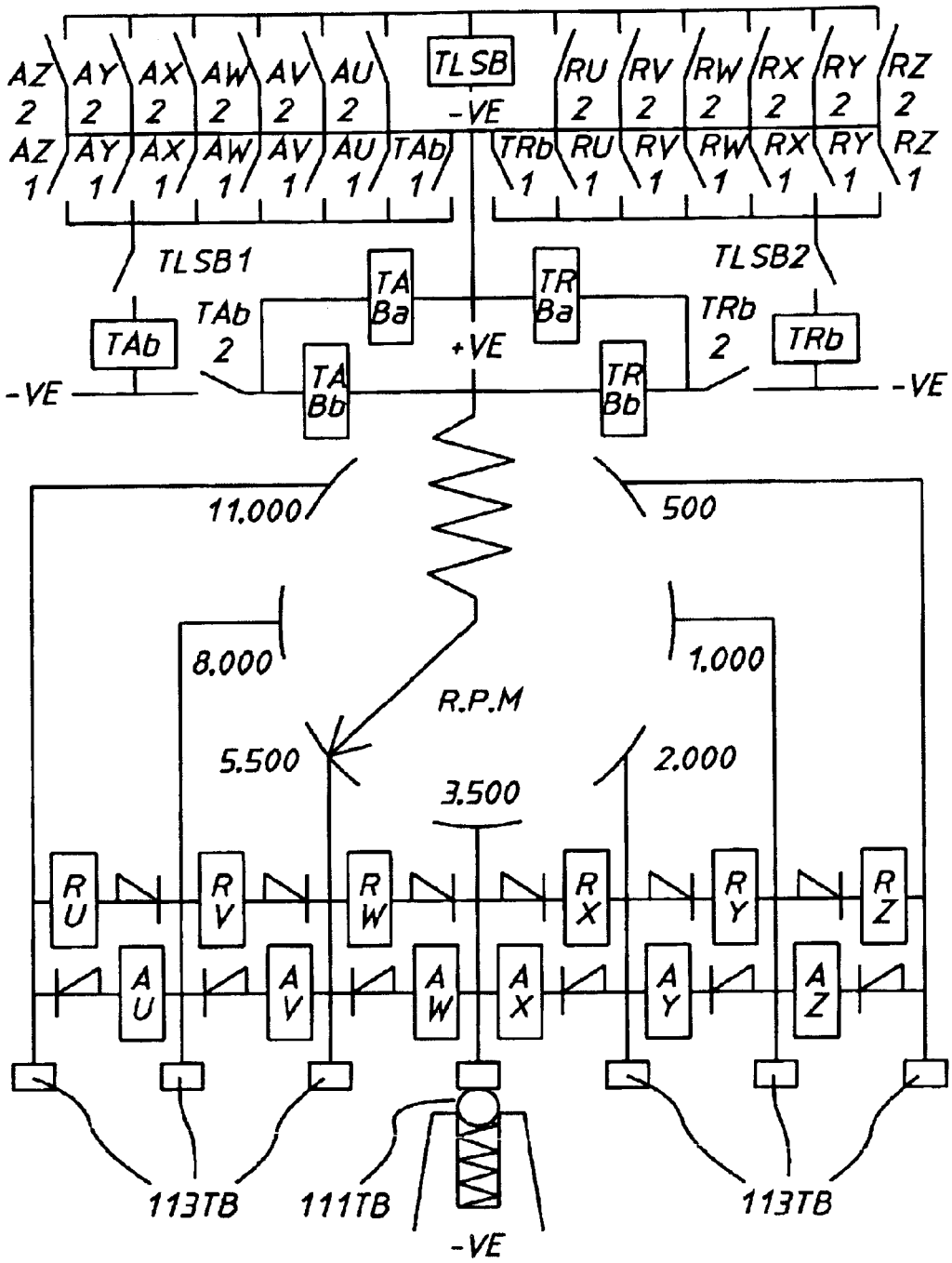
FIG. 24 is an electrical circuit to control the position of transfer timing ring "B".
Figure 25:
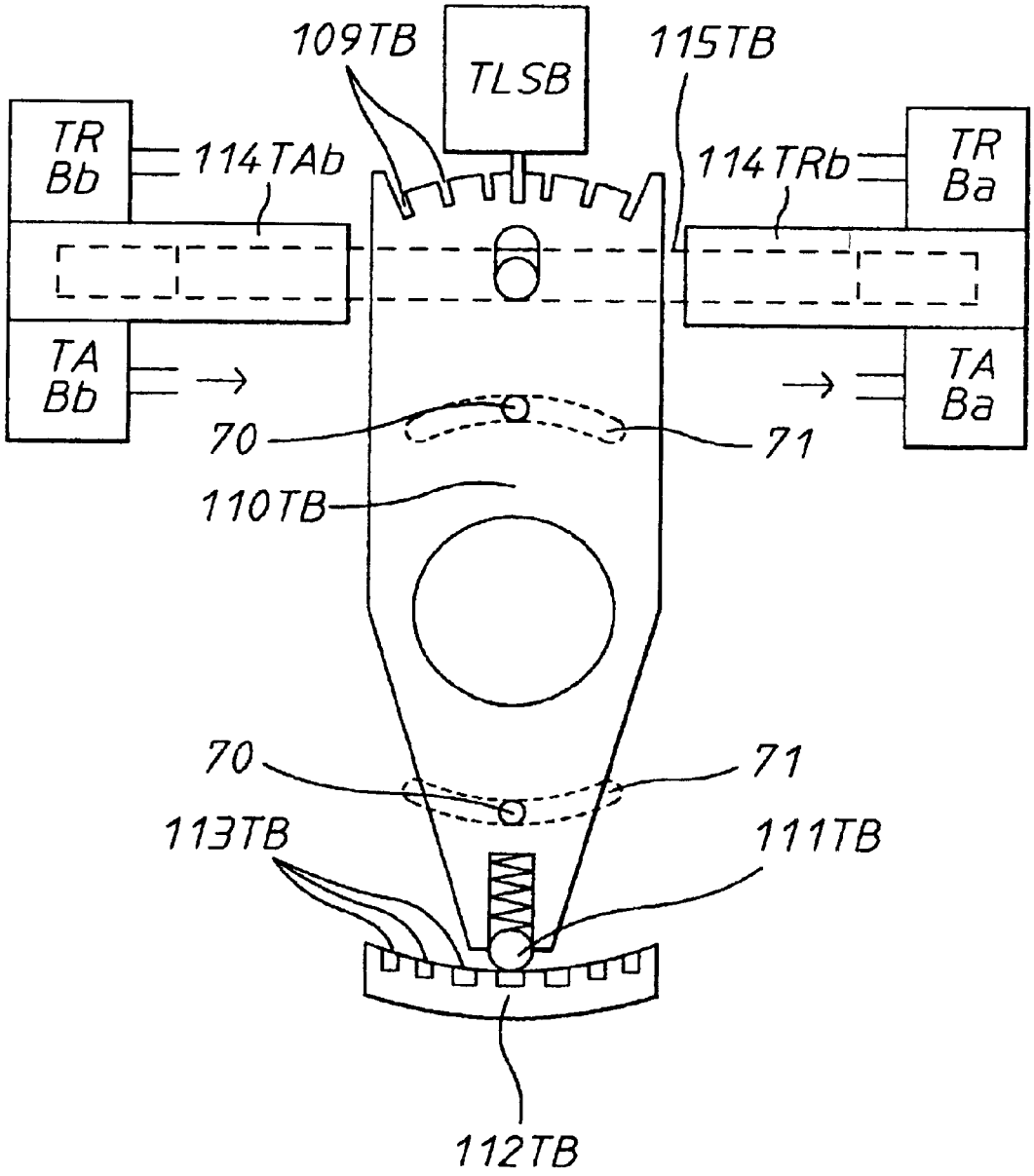
FIG. 25 is a view of the control mechanism for transfer timing ring "B".

FIG. 16 illustrates an electrical circuit and FIG. 17 illustrates a mechanism for controlling the position of the inlet timing ring 90A. The other inlet timing ring 90B is illustrated in FIG. 20 and FIG. 21 and FIG. 23 illustrates transfer timing ring 92A. FIG. 24 and FIG. 25 illustrate transfer timing ring 92B. The described operation of the inlet timing ring 90A is applicable to the other timing rings: only the identification of the parts is different, i.e. the A and B sides of the engine, and the Inlet and Transfer components of the engine.

The tachometer needle may be electrically insulated from the driving pin and the point of the needle may make contact with conductive strips associated with the engine speed control points. These points may or may not be evenly spaced, depending upon the power characteristics required from the engine. The other end of the needle may contact an insulated strip connected to a positive potential via an electrical resistance.

With reference to FIGS. 16 and 17, consider that the engine was turning at 3,500 r.p.m. and is now turning at 5,500 r.p.m. The tachometer needle applies a positive potential to the associated contact 113IA operating "RW" relay. "RW1" contact prepares the operation of "IRa" relay. "RW2" contact operates the "ILSA" locking solenoid. As the tongue of the "ILSA" locking solenoid is about to clear the groove 109IA in the inlet timing ring control plate 110IA, the "ILSA" contacts operate. "ILSA2" contact operates "IRa" relay via "RW1" being already operated. "ILSA1" contact is associated with "IAa" relay.

"IRa2" contact energizes the retard valves "IRAa" and "IRAb", permitting oil pressure to be applied to one end or the plunger rod 115IA whilst releasing pressure from the other end. Oil, under pressure from the oil pump, enters one control cylinder 114IRa and pushes the plunger rod 115IA against the inlet timing ring control plate 110IA with its attached sprung bearing contact 111IA, causing it to move and remove the negative potential from the contact 113IA on the contact control strip 112IA, releasing "RW" relay. "RW2" contact releases the "ILSA" locking solenoid to rest on the edge of the inlet timing ring control plate 110IA. The "ILSA" contacts remain operated until spring pressure causes the tongue of the "ILSA" locking solenoid to enter the next groove 109IA in the inlet timing ring control plate 110IA when it becomes aligned. This holds the inlet timing ring control plate 110IA rigidly in position and returns the "ILSA" contacts to normal. At this point the contact 113IA on the contact control strip 112IA is positioned so that a negative potential is applied to it via the sprung bearing contact 111IA in the inlet timing ring control plate 110IA. "ILSA2" contact releases "IRa" relay. "IRa2" contact releases the retard valves "IRAa" and "IRAb", removing oil pressure from the plunger rod 115IA.

Increasing engine speed to 8,000 r.p.m. would repeat a similar action via "RV" relay. Decreasing engine speed back to 3,500 r.p.m. would cause the inlet timing ring control plate 110IA to move in the opposite direction via "AW" relay energizing and the advance valves "IAAa" and "IAAb". The movement of the inlet timing ring control plate 110IA positions the associated inlet timing ring 90A via the retaining bars 94.

Figure 18:
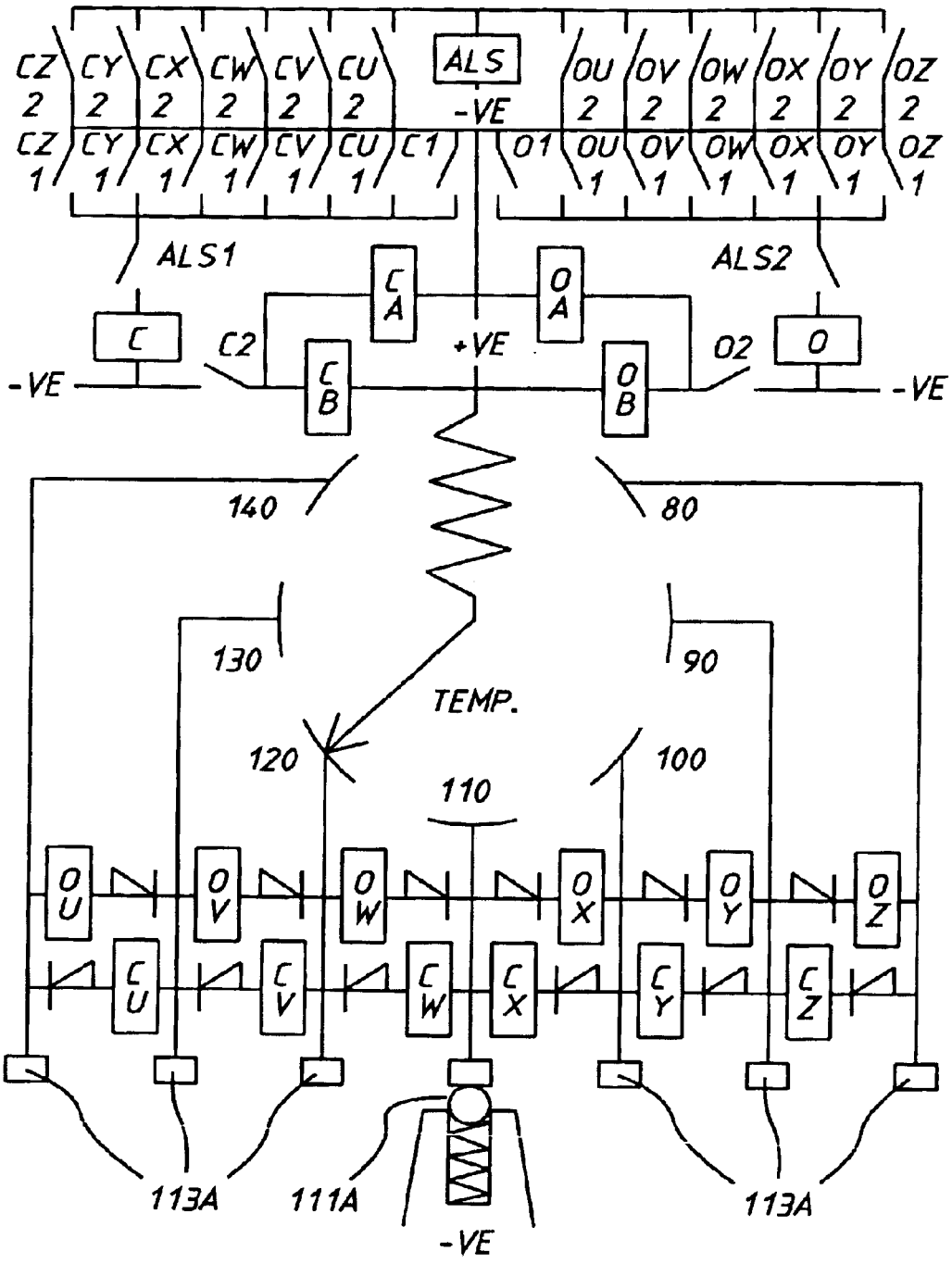
FIG. 18 is an electrical circuit to control the position of the air vents.
Figure 19:
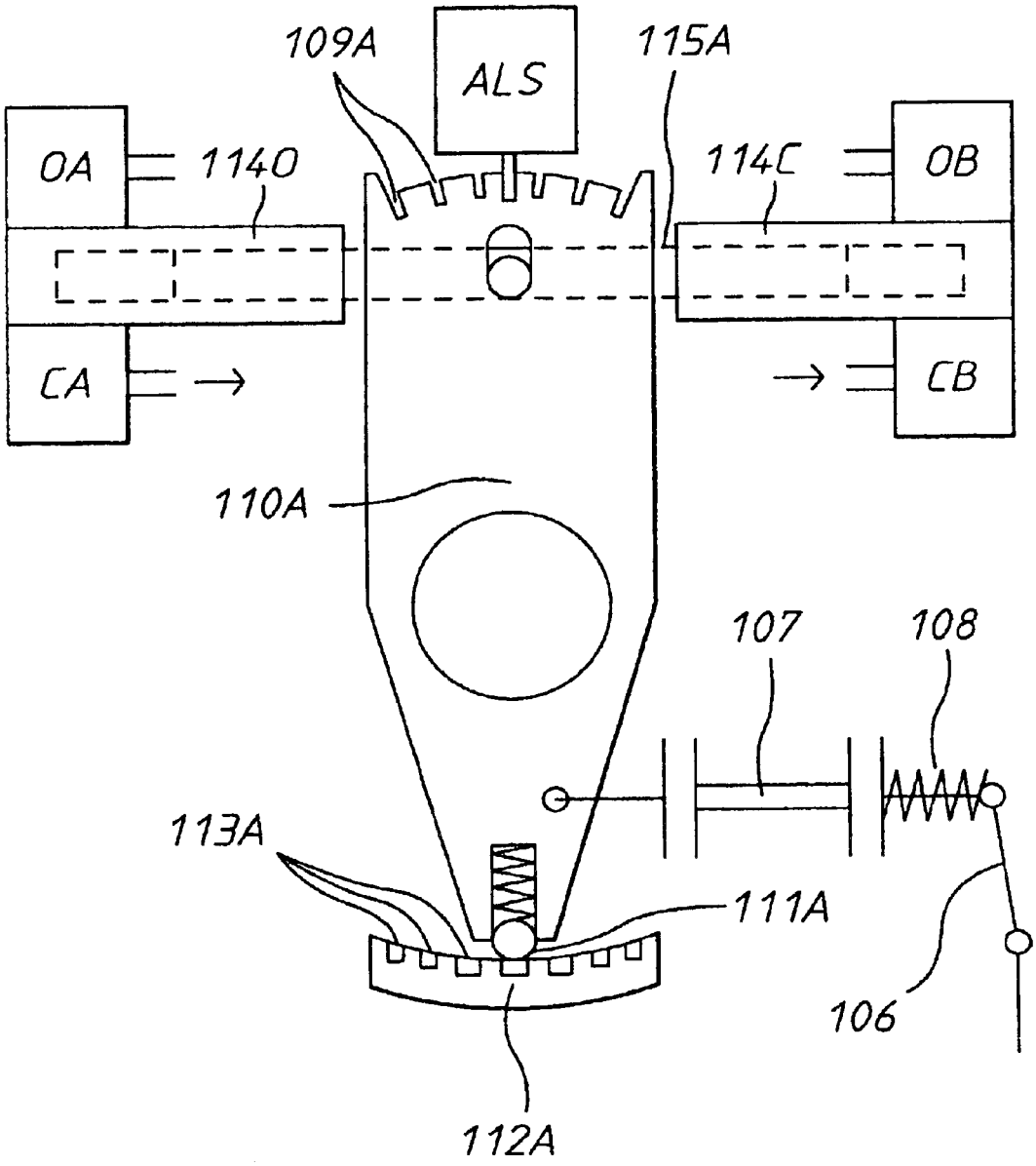
FIG. 19 is a view of the air vent control mechanism.

FIG. 18 illustrates an electrical circuit and FIG. 19 illustrates a mechanism for controlling the position of the air vents 106A and 106B. The temperature gauge needle is electrically insulated from the driving pin and its point makes contact with conductive strips associated with the engine temperature control points. The other end of the needle contacts another strip connected to a positive potential via an electrical resistance. These strips are insulated from the temperature gauge body and may or may not be evenly spaced, as also may the grooves 109A in the air vent control plate 110A, depending upon the power characteristics required from the engine 1.

With reference to FIGS. 18 and 19, consider that the engine 1 was running at 110 degrees C. and is now running at 120 degrees C. The temperature gauge needle applies a positive potential to the associated contact 113A, operating "OW" relay. "OW1" contact prepares the operation of "O" relay. "OW2" contact operates the "ALS" locking solenoid. As the tongue of the "ALS" locking solenoid is about to clear the groove 109A in the air vent control plate 110A, the "ALS" contacts operate. "ALS2" contact operates "O" relay via "OW1" contact being already operated. "ALS I" contact is associated with "C" relay.

"O2" contact energizes the opening valves "OA" and "OB", permitting oil pressure to be applied to one end of the plunger rod 115A whilst releasing pressure from the other end. The oil, under pressure from the oil pump, enters one control cylinder 1140 and pushes the plunger rod 115A against the air vent control plate 110A, with its attached sprung bearing contact 111A, causing it to move and remove the negative potential from the contact 113A on the contact control strip 112A, releasing "OW" relay. "OW2" contact releases the "ALS" locking solenoid to rest on the edge of the air vent control plate 110A. The "ALS" contacts remain operated until spring pressure causes the tongue of the "ALS" locking solenoid to enter the next groove 109A in the air vent control plate 110A when it becomes aligned. This holds the air vent control plate rigidly in position and returns the "ALS" contacts to their normal position.

At this point the contact 113A on the contact control strip 112A is positioned so that a negative potential is applied via the sprung bearing contact 111A in the air vent control plate 110A. "ALS2" contact releases "O" relay. "O2" contact releases the opening valves "OA" and "OB", removing oil pressure from the plunger rod 115A.

A temperature increase to 130 degrees C. would repeat a similar action via "OV" relay. A temperature decrease back to 110 degrees C. would cause the air vent control plate 110A to move in the opposite direction via "CW" relay and the closing valves "CA" and "CB". The movement of the air vent control plate 110A positions the air vents 106A and 106B via the control cables 107A and 107B and the tensioning springs 108A and 108B.

Features of forms of the described arrangements include:

1. On the power stroke, the piston first uncovers the outer port then uncovers the air port. No fuel/air mixture enters the outer cylinder until the transfer plate transfer orifice is opened at the correct time by the outer seal ring orifice.
2. At B.D.C. the outer cylinder is opened to atmosphere via a reed valve and the air choke allowing fresh cold air to pass across the crown of the piston and purging the outer cylinder of any residual exhaust gas.
3. The amount of purging air entering the outer cylinder is proportional to the fuel consumed by the engine because the air flow is controlled by the air choke.
4. There is no pollution of the exhaust gas by the fresh incoming charge because the exhaust plate orifice is closed by the heat resistant ceramic seal (e.g. silicon nitride or zirconium oxide) of the outer seal ring before the transfer plate transfer orifice opens.
5. Fuel wastage is minimized because any fuel/air mixture which is not passed into the outer cylinder is returned to the inlet tract via the pressure release tube.
6. The timing of the induction and/or transfer phases of the engine is varied automatically relative to the speed of the engine.
7. Engine temperature is controlled automatically under running conditions by monitoring the air and/or oil temperature and varying the flow of cooling air.
8. The electrical control circuit for the air vents may be similar to the electrical control circuit for the timing rings.
9. The control mechanism for the air vents may be similar to the control mechanism for the timing rings.
10. The ceramic coated exhaust and transfer plates are slidably mounted in heat resistant sleeves in the end casing.
11. The exhaust plate has a larger exposed surface area on the exhaust pipe side than on the cylinder side so that the pressure of the exhaust gas seals the exhaust plate against the outer seal ring.

The above describes only some of the embodiments of the present invention and modifications obvious to those skilled in the art can be made thereto without departing from the scope and spirit of the present invention.

It is to be appreciated that the port timing may be changed as also may the length and positioning of the tracts (with relative changes to the appropriate seal ring orifices) in accordance with experimental data obtained in relation to parameters such as gas flow and velocity, port shape, the torque of the engine and the desired speed limit.

INDUSTRIAL APPLICABILITY

This invention may be applied to internal combustion engines, heat engines operating on internal or external combustion, hydraulic pumps or motors, pneumatic motors or compressors or steam engines or turbines of the rotary type. Use as a steam engine would require all seal rings to be ceramic coated.

What is claimed is:

1. A two-stroke motor of the rotary piston type comprising:

an engine housing;

a cylinder block rotatably mounted in the engine housing for rotation relative thereto;

a plurality of cylinders housed within the cylinder block;

a plurality of piston members, each member respectively within and associated with each cylinder;

a crankshaft indirectly geared to the cylinder block, the crankshaft journaled for a rotation within the engine housing, the piston members supported upon the crankshaft for a linear motion within the cylinder block as the crankshaft and the cylinder block rotate;

slidably mounted circular seal rings for sealing the cylinder block against the engine housing; and a rotatable timing ring to automatically vary the transfer phase of said motor in response to changes in the rotational speed of said motor.

2. A two-stroke motor of the rotary piston type comprising:

an engine housing;

a cylinder block rotatably mounted in the engine housing for rotation relative thereto;

a plurality of cylinders housed within the cylinder block;

a plurality of piston members, each member respectively within and associated with each cylinder;

a crankshaft indirectly geared to the cylinder block, the crankshaft journaled for a rotation within the engine housing, the piston members supported upon the crankshaft for a linear motion within the cylinder block as the crankshaft and the cylinder block rotate;

slidably mounted circular seal rings for sealing the cylinder block against the engine housing; and at least one rotatable timing ring operatively connected to the engine housing, to automatically advance or retard the induction phase of said motor in response to changes in the rotational speed of said motor.

3. A two-stroke motor of the rotary piston type comprising:

an engine housing;

a cylinder block rotatably mounted in the engine housing for rotation relative thereto;

a plurality of cylinders housed within the cylinder block;

a plurality of piston members, each member respectively within and associated with each cylinder;

a crankshaft indirectly geared to the cylinder block, the crankshaft journaled for a rotation within the engine housing, the piston members supported upon the crankshaft for motion within the cylinder block as the crankshaft and the cylinder block rotate;

slidably mounted circular seal rings for sealing the cylinder block against the engine housing; and at least one automatically rotatable induction timing ring operatively connected to the engine housing;

wherein the at least one rotatable timing ring is provided to automatically vary the induction phase of said motor in response to changes in the rotational speed of said motor.

4. The motor of claim 3 wherein epicyclic gears are provided to indirectly gear the cylinder block to the crankshaft by a ratio of 2:1.

5. The motor of claim 4 wherein the epicyclic gears are piggyback idler gears.

6. The motor of claim 3 wherein the cylinder block and crankshaft rotate in the same direction relative to the engine housing.

7. A motor as in one of claims 3–5 wherein the engine housing includes end casings; side entry and exit ports are located in the end casings; ports are provided in the cylinders, the side entry ports and cylinder ports in fluid communication to assist entry of combustion gases into the cylinders.

8. The motor of claim 7 wherein rotating cylinder-side seal rings and stationary casing-side seal rings and casing-side exhaust plates seal the cylinder ports and said side entry and exit ports by intimate contact therewith.

9. The motor of claim 8 wherein at least one air choke and at least one reed valve are provided to open the cylinders to atmosphere after combustion, allowing an air charge to pass across a crown of individual ones of said piston members, thereby purging said cylinders of a residual exhaust gas.

10. The motor of claim 9 wherein the quantity of said air charge is synchronized by the at least one air choke and reed valve to be proportional to the quantity of fuel/air mixture consumed by said motor.

11. The motor of claim 8 wherein the sealing of the casing-side exhaust plate against a cylinder-side outer seal ring is accomplished by the pressure of the exhaust gas.

12. The motor of claim 3 wherein an automatically variable air vent opening in a periphery of the housing is provided to assist in ensuring that the temperature of said motor remains generally within selected limits during operation.

13. The motor of claim 3 wherein a connecting rod is provided, having a big-end, and rigid guides in the crank case are provided to control and support a movement of the big-end.

14. The motor of claim 3 wherein air ports are provided in a cylinder wall, and an internal portion is provided in the or each piston member, which is cooled via the air ports.

15. The motor of the claim 3 wherein a primary compression of an induced gas is increased due to a solid base of said piston members meeting flush with said cylinder block.

16. The motor of the claim 3 wherein a charge used to power the motor having an unused portion, is returned to an incoming charge.

17. The motor of the claim 3 wherein one or more compressible synthetic rubber O-ring seals are provided, which, in combination with the slidably mounted seal rings, provide effective sealing of the motor even under thermal expansion of said motor upon reaching an operating temperature.

18. A motor as in one of claims 3, 2, or 1, wherein a pivotable plate is provided; linear actuators connected to the plate are provided, connected substantially at an end of said pivotable plate, said pivotable plate operatively connected to the rotatable ring or air vent opening, to effect the automatic advancement or retardation.

19. The motor of the claim 18 wherein solenoids having extendible portions are provided to lock or unlock the plate into or from one or more selected positions, detent regions provided to receive the or each extendible portion.

* * * * *